US012104848B1

(12) United States Patent
Dauchot

(10) Patent No.: US 12,104,848 B1
(45) Date of Patent: Oct. 1, 2024

(54) COOLING DEVICE FOR COOLING BEVERAGES

(71) Applicant: Michael Dauchot, La Jolla, CA (US)

(72) Inventor: Michael Dauchot, La Jolla, CA (US)

( * ) Notice: Subject to any disclaimer, the term of this patent is extended or adjusted under 35 U.S.C. 154(b) by 0 days.

(21) Appl. No.: 18/618,795

(22) Filed: Mar. 27, 2024

Related U.S. Application Data

(60) Provisional application No. 63/455,061, filed on Mar. 28, 2023.

(51) Int. Cl.
*F25D 31/00* (2006.01)

(52) U.S. Cl.
CPC ..... *F25D 31/007* (2013.01); *F25D 2331/803* (2013.01); *F25D 2331/805* (2013.01)

(58) Field of Classification Search
CPC ..... F25D 31/002; F25D 31/007; F25D 31/006
USPC ..... 165/177
See application file for complete search history.

(56) References Cited

U.S. PATENT DOCUMENTS

| | | | | |
|---|---|---|---|---|
| 3,161,031 | A | 12/1964 | Flannery | |
| 4,266,407 | A | 5/1981 | Gibson | |
| 4,481,792 | A * | 11/1984 | Groeger | B65D 81/3827 62/457.5 |
| 2019/0178572 | A1* | 6/2019 | Jacob | F25D 17/045 |
| 2022/0297920 | A1 | 9/2022 | Swartz | |

FOREIGN PATENT DOCUMENTS

| | | | |
|---|---|---|---|
| DE | 202004014250 | U1 | 12/2004 |
| DE | 202019003067 | U1 | 11/2019 |
| WO | 2007045239 | A1 | 4/2007 |

OTHER PUBLICATIONS

International Search Report and Written Opinion for Application No. PCT/US2024/021711, mailed May 31, 2024, 8 pages.

* cited by examiner

*Primary Examiner* — Steve S Tanenbaum
(74) *Attorney, Agent, or Firm* — Lewis Roca Rothgerber Christie LLP

(57) ABSTRACT

A cooling device for cooling a fluid includes first and second bodies each having a first end, a second end, a longitudinal axis, an inner face, an outer face, and two side faces connecting the inner and outer faces. When the first and second bodies are assembled together with the respective inner faces facing one another, the inner faces together define a cylindrical chamber with a cylinder axis that extends parallel to the longitudinal axes, with the cylindrical chamber having a first radius and extending substantially entirely around the cylinder axis in a circumferential direction, for receiving a container with a cylindrical portion having the first radius. Each of the first and second bodies is solid and is formed using a material or alloy with a thermal conductivity of at least 75 $Wm^{-1}K^{-1}$ when at zero degrees Fahrenheit that extends substantially uniformly throughout substantially the entire body.

20 Claims, 15 Drawing Sheets

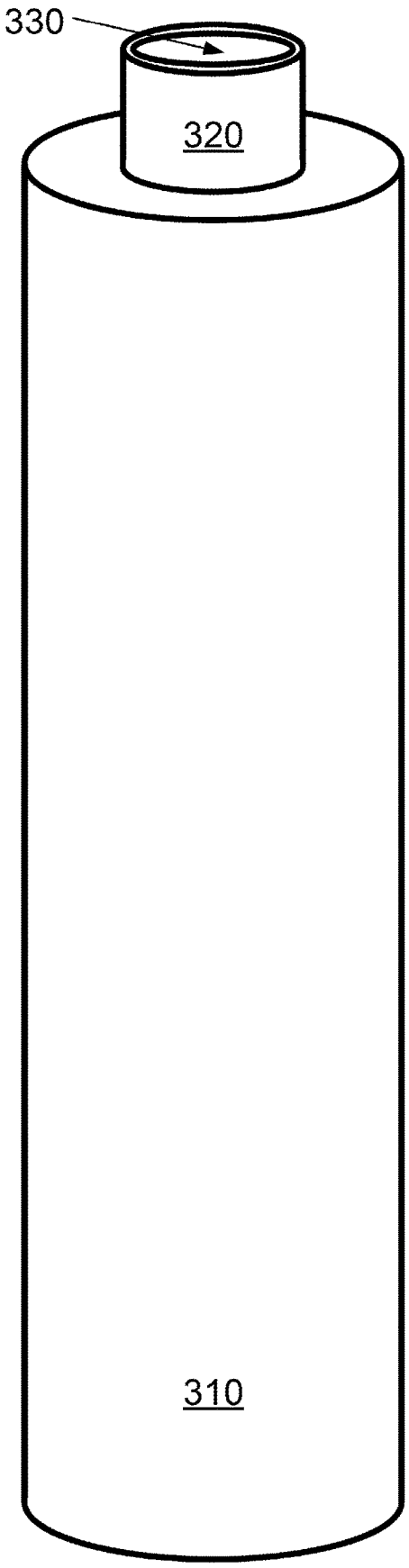
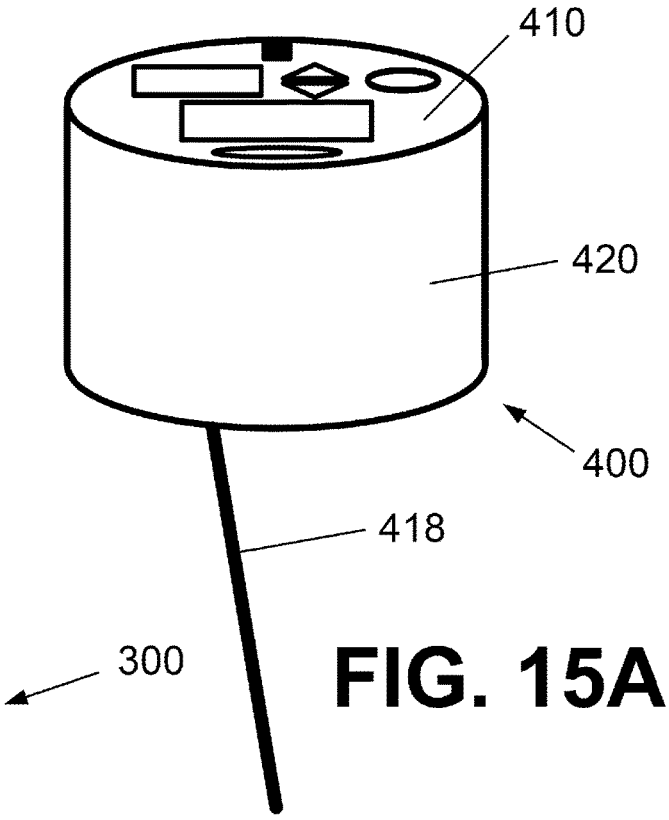
FIG. 15A
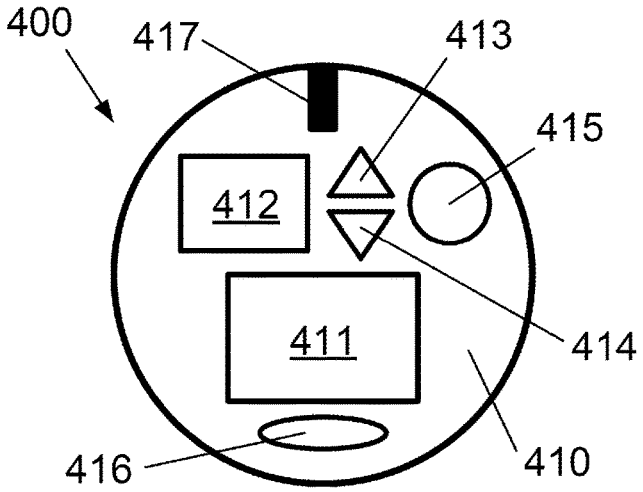
FIG. 15B
FIG. 14

COOLING DEVICE FOR COOLING BEVERAGES

CROSS-REFERENCE TO RELATED APPLICATION(S)

The present application claims priority to and the benefit of U.S. Provisional Application No. 63/455,061, filed Mar. 28, 2023, the entire content of which is incorporated herein by reference.

BACKGROUND

The application relates to a cooling device for cooling beverages therein. The cooling device provides a chamber for holding a beverage container to be cooled or chilled in a rapid manner. The application also relates to a container adapted for use with the cooling device, and to a system including the cooling device and the container.

In a conventional freezer, the air inside is typically maintained at or around 0 degrees Fahrenheit. When an object at room temperature (e.g., 72 or 73 degrees Fahrenheit) is placed inside a freezer, its heat will be transferred to the cooler surrounding air and nearby structures and objects to which it comes into contact. However, the rate of which the heat is transferred from the object to the surrounding environment, thereby cooling the object to a colder temperature, is typically slower than one would like. This is especially true in the case of beverages. For example, it may take up to 45 minutes to drop the temperature of a soda or other beverage held in a standard 12 ounce can from room temperature to 45 degrees Fahrenheit if the beverage can is simply placed in a freezer in a typical manner. A typical bottle of white wine may take even longer to chill, due to factors such as the larger size of a standard wine bottle, and weaker thermal conductivity of a glass bottle compared to an aluminum can, among other factors.

SUMMARY

There is therefore a need to provide a more dynamic chilling or cooling device that is capable of more rapidly cooling beverages and other liquids from room temperature. A cooling device according to embodiments of the invention provides a more efficient mode of heat transfer from a beverage container into the cooling device, thereby lowering the temperature of the beverage held in the container at a more rapid pace. In essence, the cooling device more efficiently and compactly stores the chilling properties of a freezer by surrounding the container with a dense block of aluminum, aluminum alloy, or other material with strong thermal conductivity, to more effectively transfer heat between the cooling device and the container and thereby lower the temperature of a container and stored beverage held therein in a more rapid fashion.

Cooling devices according to embodiments of the invention are configured to be placed in a freezer compartment, so that the core temperature of the cooling device is maintained between 0 and 10 degrees Fahrenheit when not in use. When a beverage can or container at a warmer temperature is placed inside a chamber of the cooling device, a thermal equilibration process immediately begins, and the temperature of the cooling device and the fluid inside the container immediately begin to converge. This process occurs because, due to the differential in temperatures between the cooling device and the beverage container, the mass of the cooling device rapidly draws heat from the fluid inside the container back to itself, lowering the temperature of the container and the fluid inside, while increasing the temperature of the cooling device itself. The strong thermal conductivity of the cooling device allows this process to occur more rapidly than if the heat transfer is only via the cold air in the freezer.

BRIEF DESCRIPTION OF THE DRAWINGS

Further features and advantages of the invention will become apparent from the description of embodiments by means of the accompanying drawings. In the drawings:

FIG. 14 shows a container configured for use with embodiments of the cooling device, according to an embodiment of the invention.

FIG. 15A shows a perspective view from a side of a cap configured for use with the bottle of FIG. 14, according to an embodiment of the invention.

FIG. 15B shows a top view of the cap of FIG. 15A.

DETAILED DESCRIPTION

Figure 1:
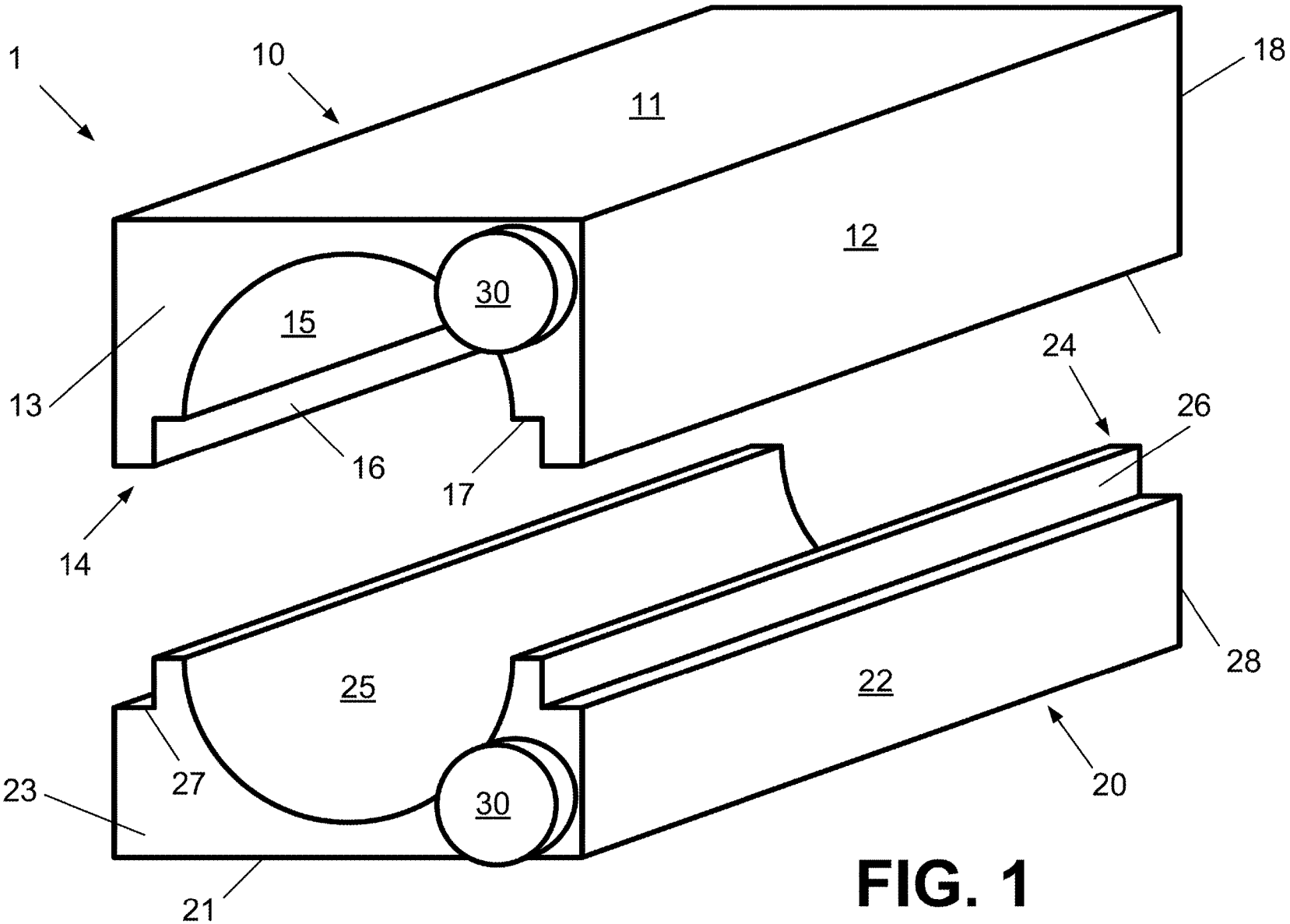
FIG. 1 shows a perspective view from a front of a cooling device according to a first embodiment of the invention in an unassembled state.

Referring to FIGS. 1 to 7, a first embodiment of a cooling device 1 for cooling beverages includes a first or top device body or shell 10 that is configured to be assembled together with a second or bottom device body or shell 20. The first body 10 includes an outer surface or face 11, two side surfaces or faces 12, a front surface or face 13, an inner surface or face 14, and a back surface or face 18. In some embodiments, the first body 10 has an outer profile corresponding to a rectangular prism, with a length extending between the front and back faces 13, 18 being longer than a width extending between opposing side surfaces 12. Other embodiments of the invention may instead employ first bodies with various other shapes, for example, cuboid, trapezoidal, etc., or may employ other variations such as rounded edges.

The first body 10 is configured to be assembled to the second body 20 with the inner face 14 facing the second body 20. The outer face 11 is configured to be flat for ease of placement on flat surfaces. The inner face 14 includes a cylindrical segment-shaped recess 15 that runs along an entire length of the first body 10 and that is open to the front and back faces 13, 18. The cylindrical recess 15 may be sized, for example, to receive and closely contact a body of a standard soda can, which has a 66 mm diameter. To this effect, the cylindrical recess 15 may have a radius of curvature of, for example, 33 mm. Other embodiments may include larger or smaller recesses, and/or recesses of different shapes, to facilitate receiving of different sized containers therein. The cylindrical recess 15 formed on the first body 10 may include exactly half of a full cylinder shape, to facilitate easy insertion of a soda can or other appropriately sized beverage container into the cylindrical recess 15 from a direction transverse to the inner face 14. In other embodiments, the cylindrical recess may include less, or even more, of a half of a full cylinder shape. In embodiments where more than half of a full cylinder shape is formed, insertion of a correspondingly sized container may only be facilitated in a lengthwise direction, or in other words, slid in from the front face or the back face.

The cylindrical recess 15 is sized so as to make the first body 10 form a substantially U-shaped cross-section. In addition to the cylindrical recess 15, the inner face 14 of the first body further defines a longitudinally extending recess 16 on either side of the cylindrical recess 15, each of which also extends from the front face 13 to the back face 18. The recesses 16 are in communication with the cylindrical recess 15 and further form abutments 17 that extend laterally outwardly from the cylindrical recess 15. The abutments 17 are configured to abut against a portion of the second body 20 when the bodies 10, 20 are assembled together, as will be described in greater detail below. In the embodiment shown, the recesses 16 each has a rectangular cross-section, but may be otherwise shaped in other embodiments. Furthermore, in the embodiment shown, a depth of the recesses 16 measured between the inner face 14 and the cylindrical recess 15 is greater than a width of the abutments 17, but in other embodiments, the relative sizes between the depth of the recesses 16 and the width of the abutments 17 may be differently arranged.

Figure 3A:
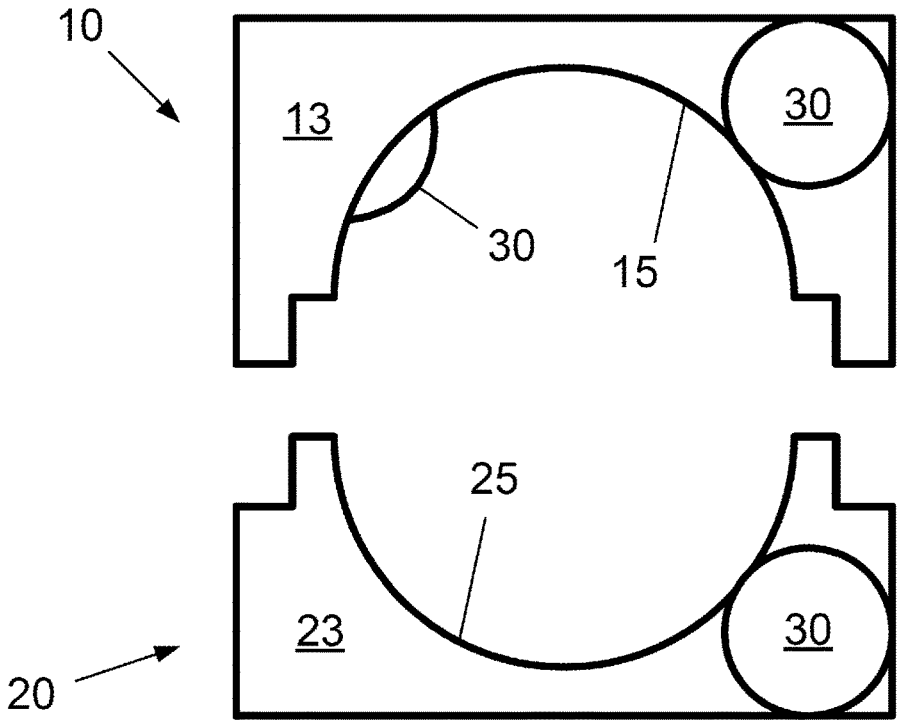
FIG. 3A shows a front view of the cooling device of FIGS. 1 to 2B in the unassembled state.
Figure 3B:
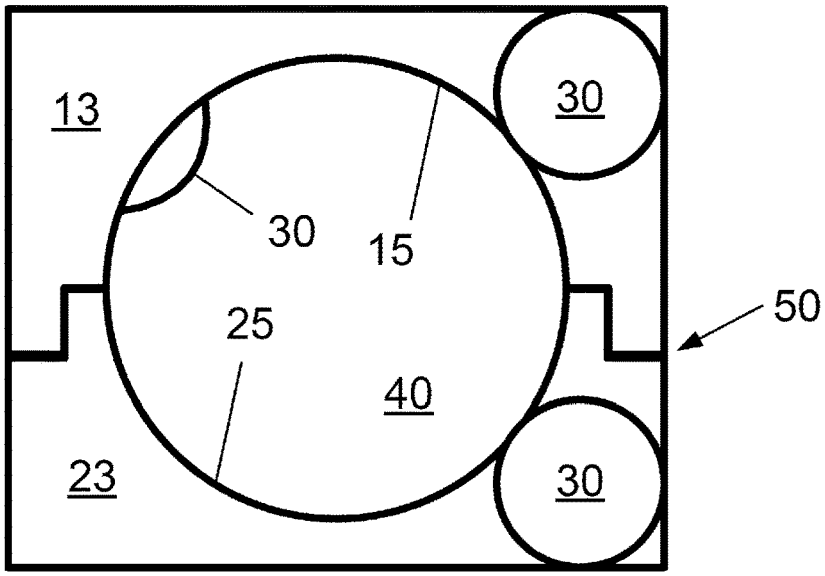
FIG. 3B shows the front view of the cooling device of FIGS. 1 to 3A in the assembled state.
Figure 4:
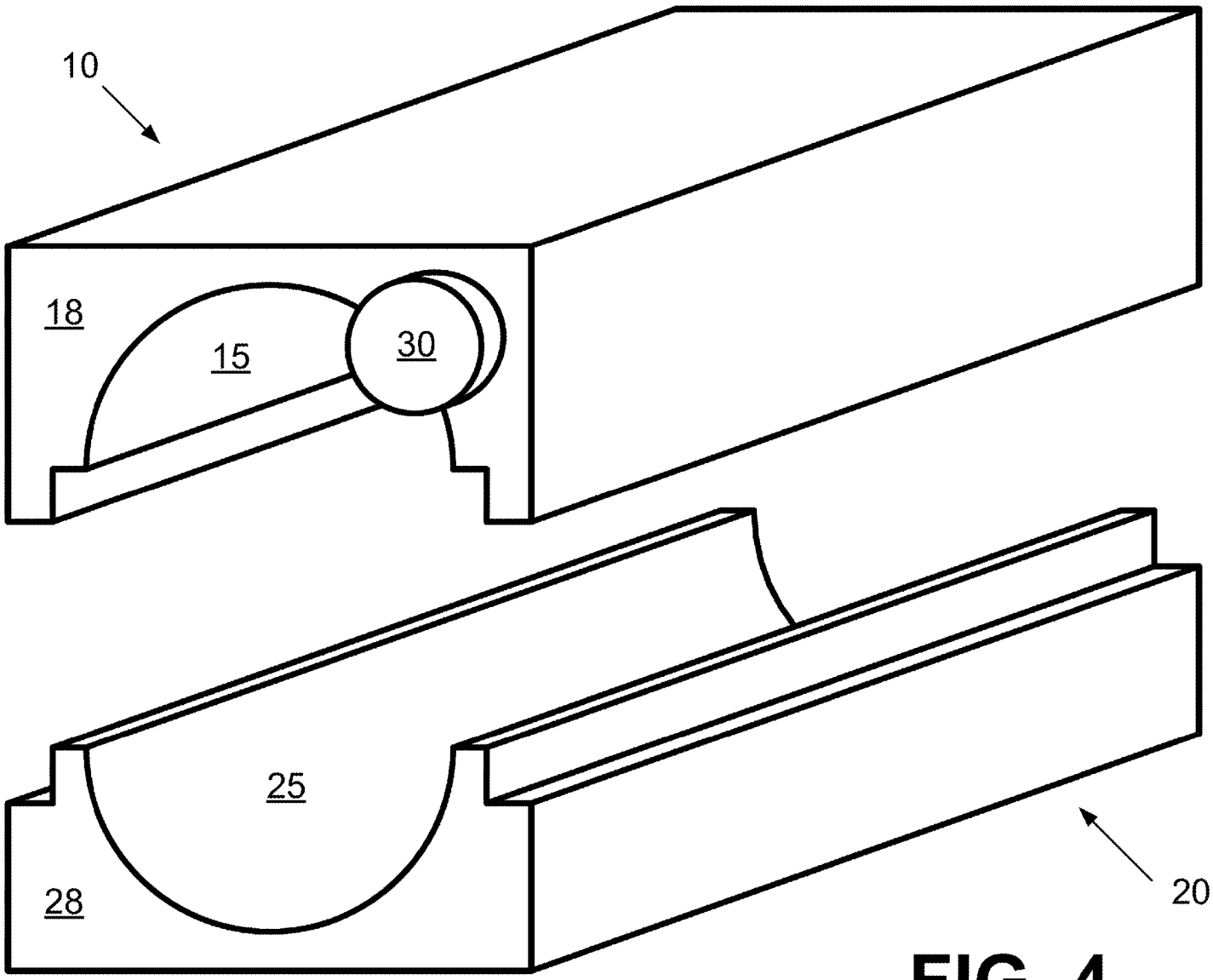
FIG. 4 shows a perspective view from a back of the cooling device of FIGS. 1 to 3B in the unassembled state.
Figure 5:
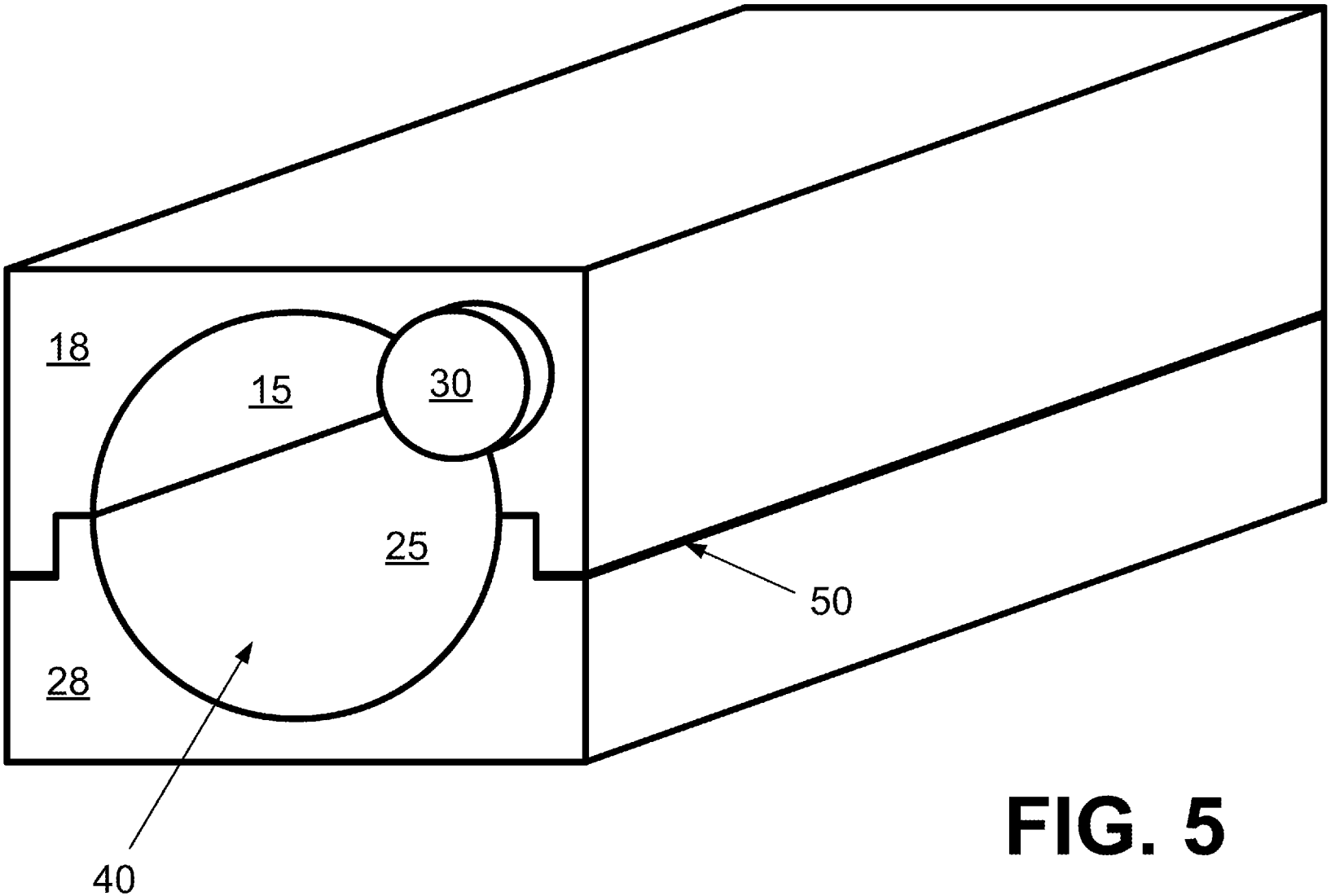
FIG. 5 shows the perspective view from the back of the cooling device of FIGS. 1 to 4 in the assembled state.
Figure 6A:
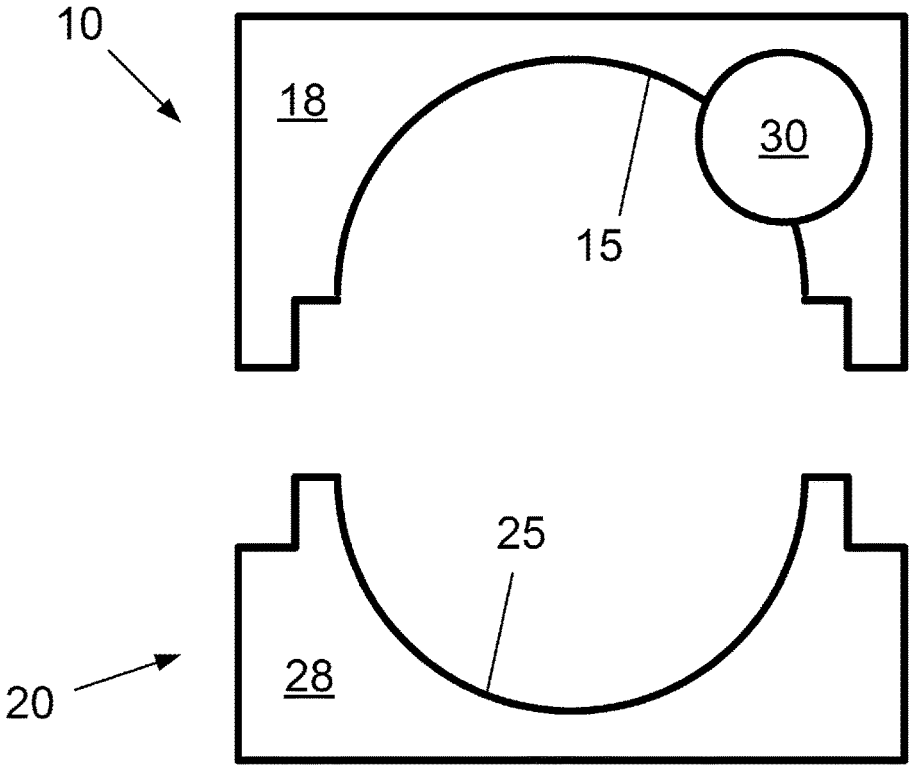
FIG. 6A shows a back view of the cooling device of FIGS. 1 to 5 in the unassembled state.
Figure 6B:
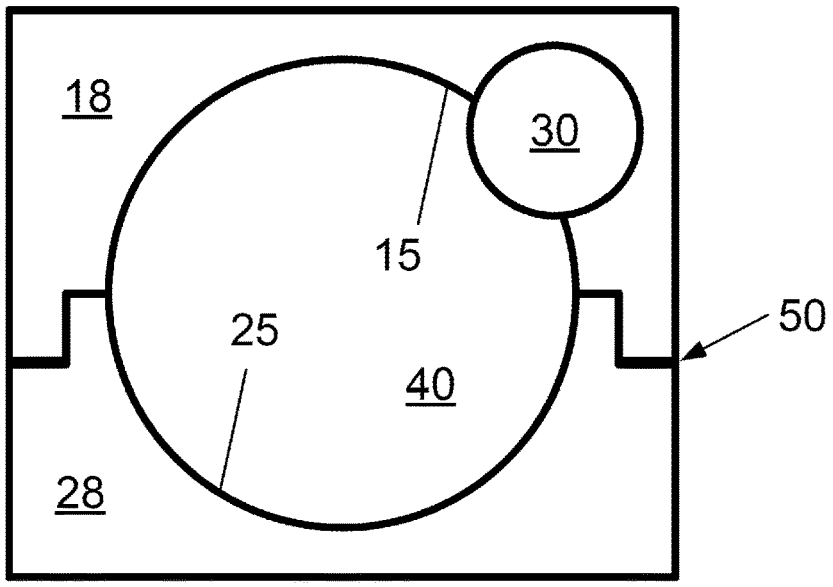
FIG. 6B shows the back view of the cooling device of FIGS. 1 to 6A in the assembled state.

Furthermore, a first knob 30 is connected to the front face 13 of the first body 10, and a second knob 30 is connected to the back face 18 (see, e.g., FIGS. 4 to 7). Knobs may be attached to the first and/or second bodies so that a user can manipulate the cooling device without directly contacting the chilled and relatively cold bodies directly. The first and second knobs 30 may be identical, and are labeled with the same reference number in the embodiment shown as a result. In other embodiments, different knobs may have different shapes and/or sizes. As best shown in FIGS. 3A and 3B, the knob 30 connected to the front face 13 is arranged so as not to extend laterally into the path of the cylindrical recess 15. As such, a container held in the cylindrical recess 15 may be more easily pulled out and removed from the front face 13 without the knob 30 connected to the front face obstructing the removal. The knob 30 connected to the front face 13 can help, for example, to facilitate pulling and/or lifting of the first body 10 away from the second body 20 to insert a container under it. Further, as seen in FIGS. 3A, 3B, 6A, and 6B, the second knob 30 connected to the back face 18 may be positioned radially closer to a center of the cylindrical recess 15, to an extent that the knob may extend into and obstruct a pathway formed by the cylindrical recess 15. This may be arranged intentionally in this way, so as to form a stop against, for example, an inserted container from being removed or inadvertently sliding out of the back end of the cooling device when the cooling device is assembled and is holding the container. Furthermore, if a user pulls on the knob 30 on the front face 13 to slide the first body towards the user, the knob 30 on the back face 18 can act as a backstop that effectively eases and slides a container held in the cooling device towards the user together with the first body 10, so that when the first body 10 is lifted away from the second body 20, the container held in the cooling device might be pulled laterally closer to the user to further ease removal. The knob 30 on the back face 18 may also help with easier handling of the first body 10 for cleaning and/or repositioning.

The second body 20 is formed similarly to the first body 10, and goes below the first body 10 in an assembled state. The second body 20 in the described embodiments may serve as a base of the cooling device 1. The second body 20 includes an outer surface or face 21, two side surfaces or faces 22, a front surface or face 23, an inner surface or face 24, and a back surface or face 28, where the inner face 24 is configured to face the first body 10 when the first and second bodies 10, 20 are assembled together. Similarly to the first body 10, the outer face 21 of the second body 20 is configured to be flat for ease of placement on flat surfaces, and to maximize or otherwise increase surface contact with a shelf or freezer floor on which the second body 20 is placed to more readily and effectively conduct heat away from the second body 20 to the shelf or floor. Also similarly to the first body 10, the inner face 24 also defines a cylindrical segment-shaped recess 25. Here, the cylindrical recess 25 forms exactly half of a cylinder to match the half cylinder formed by recess 15, such that when the first and second bodies 10, 20 are assembled together, the cylindrical recesses 15, 25 together form a full cylindrically shaped tunnel or chamber 40 that extends through the length of the cooling device 1. It shall be noted that in embodiments where the cylindrical recess of the first body may form more than half of a cylinder, the cylindrical recess of the second body may correspondingly form less than half of a cylinder, or vice versa, so that the two recesses together will form a full cylindrical chamber. In addition, while the cylindrical recesses 15, 25 are shown to extend entirely through their respective bodies 10, 20, in some embodiments, the bodies may be closed at either the first faces 13, 23, or the second faces 18, 28, or both, so that the chamber 40 formed by the recesses 15, 25 may be closed and inaccessible from either or both sides of the cooling device when assembled. Other modifications may also be contemplated without departing from the spirit and scope of the invention.

The second body 20 also includes additional recesses 26 formed in the inner face 24, but unlike the recesses 16 of the first body 10, the recesses 26 of the second body 20 are not in communication with the cylindrical recess 25. Rather, the recesses 26 are formed between the inner face 24 and the side faces 22 of the second body 20, so as to be accessible from and open to the sides of the second body. The dimensions of the recesses 26 are selected to provide a form-fit connection with the recesses 16 of the first body 10 when the bodies 10, 20 are assembled together. In other words, when the first and second bodies 10, 20 are assembled together, the recesses 16, 26 are arranged so that the first and second bodies 10, 20 form a form-fit connection therebetween, while the cylindrical recesses 15, 25 form a cylindrical chamber 40 that extends substantially uninterruptedly from the front faces 13, 23 to the back faces 18, 28. As such, the depth of the recess 26 measured from the inner face 24 to a ledge 27 in the embodiment shown is greater than a width of the ledge 27, similar to the size and arrangement of the recess 16. However, in other embodiments, the relative dimensions between the recess 26 and ledge 27 may be different, to correspond to the size of the recesses 16.

Figures 2A, 2B:
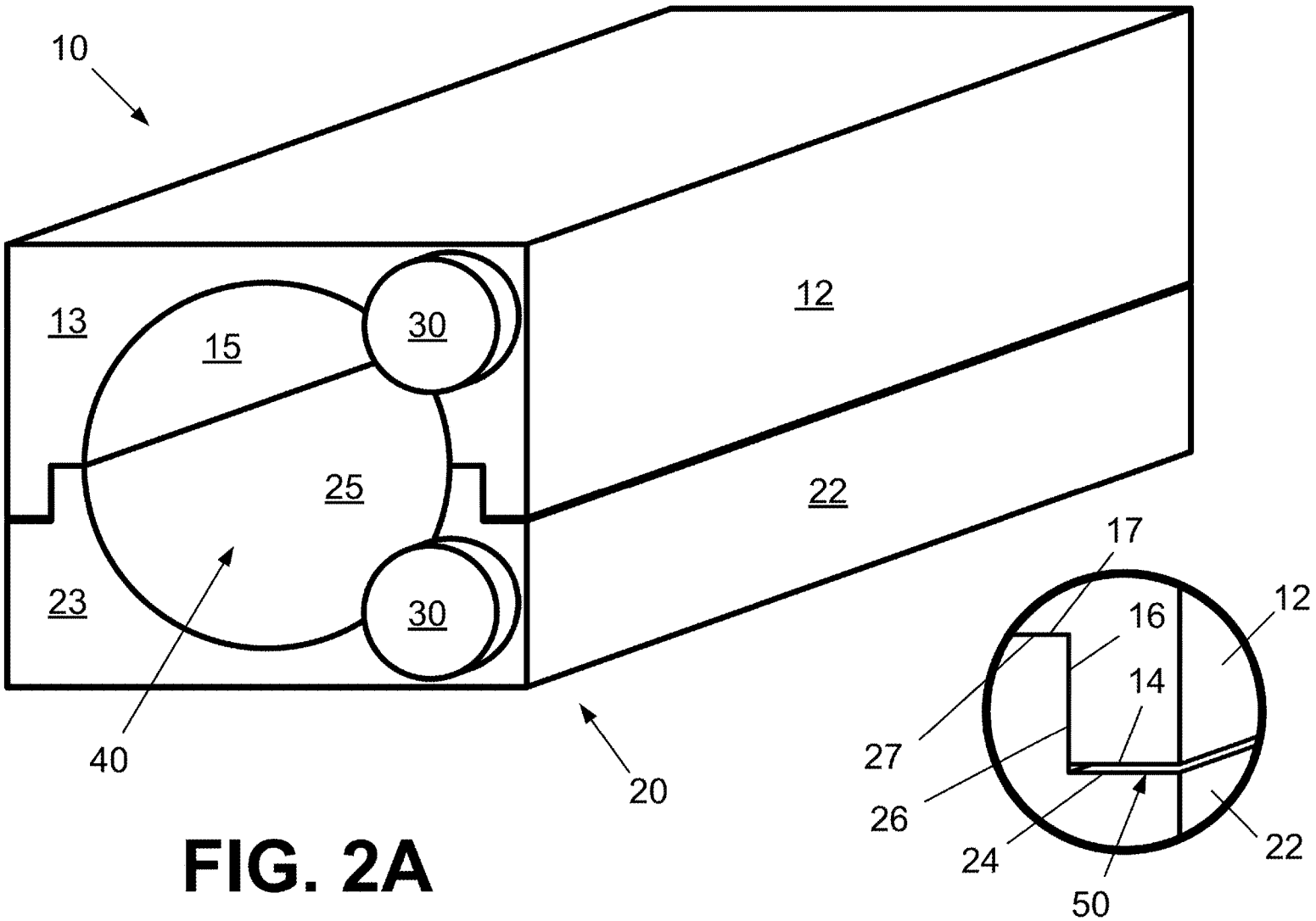
FIG. 2A shows the perspective view from the front of the cooling device of FIG. 1 in an assembled state.
FIG. 2B shows a close-up view of a detail of FIG. 2A.

As best seen in the enlarged portion illustrated in FIG. 2B, in the embodiment shown, a depth of the recess 26 of the second body 20 may be slightly greater than a depth of the recess 16 of the first body 10, to ensure that the inner face 24 of the second body 20 abuts against the abutment 17 of the first body 10, and that the inner walls defining the recesses 15, 25 meet so that there are no gaps formed therebetween along the length of the cooling device 1 when the chamber 40 is formed. Bodies 10, 20 that are allowed to be closely assembled in this manner is important to optimize surface contact with an inserted container, consequently optimizing cooling speed and efficiency as well. Due to the differential in depths between the recesses 16 and 26, a gap 50 may be formed on an outside of the cooling device when assembled, to provide for greater tolerance in facilitating a more closely assembled inner chamber 40.

In some embodiments (not shown), additional surface features, for example, one or more additional ribs and grooves, may be provided at select positions along the length of the inner surfaces 14, 24, which may inhibit longitudinal sliding between the bodies 10, 20. Alternatively, stops formed at either the front or back faces, or both, or other features providing similar functionality, may serve a similar function (not shown).

Similar to the first body 10, the second body 20 may also facilitate attachment of a knob 30 on its front face, and may also be positioned to avoid obstructing the cylindrical recess 25. As such, as best seen in FIG. 3B, when the cooling device 1 is assembled together, both of the knobs 30 respectively assembled to the front faces 13, 23 of the bodies 10, 20, do not extend into or obstruct the chamber 40 formed by the cylindrical recesses 15, 25. The opposing knobs 30 arranged in this position, may help to facilitate easier movement or manipulation by a user between the first and second bodies 10, 20. For example, the knobs 30 can be used to slide the bodies 10, 20 relative to one another, or to separate the bodies 10, 20 from one another. In another usage, if direct access to a held container is available, the user can pull on the held container while holding the second body 20 in place with the knob 30 attached to the front face 23, to more easily slide the container out relative to the second body 20. In the embodiment shown, the second body 20 does not further include a second knob on its back face 28. However, in other embodiments and designs, more or less knobs may be employed to help facilitate easier operation of the cooling device, and/or for any other purpose.

Figure 7:
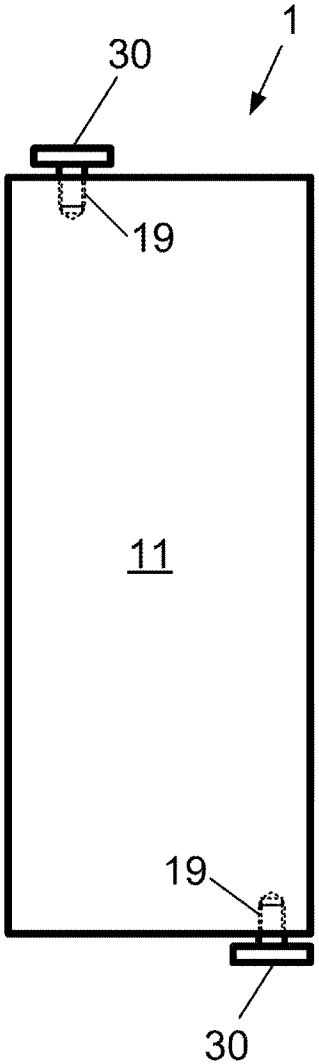
FIG. 7 shows a top view of the cooling device of FIGS. 1 to 6B.

The knobs 30 are shown as screw-in knobs that have an enlarged head for easier handling by a user. As best seen in FIG. 7, the first and second bodies 10, 20 may have bores 19 at select locations to facilitate insertion and connection of the knobs 30. The bores 19 may be threaded to facilitate threadable insertion of the knobs 30, as well as to facilitate easy removal for easier handling and more versatility. The knobs 30 are illustrated as having enlarged heads which are round or circular in shape, but other embodiments may have other knob head designs, for example, ridged edges and/or edges with larger contours or other surface features to facilitate better grip for a user.

Figure 8B:
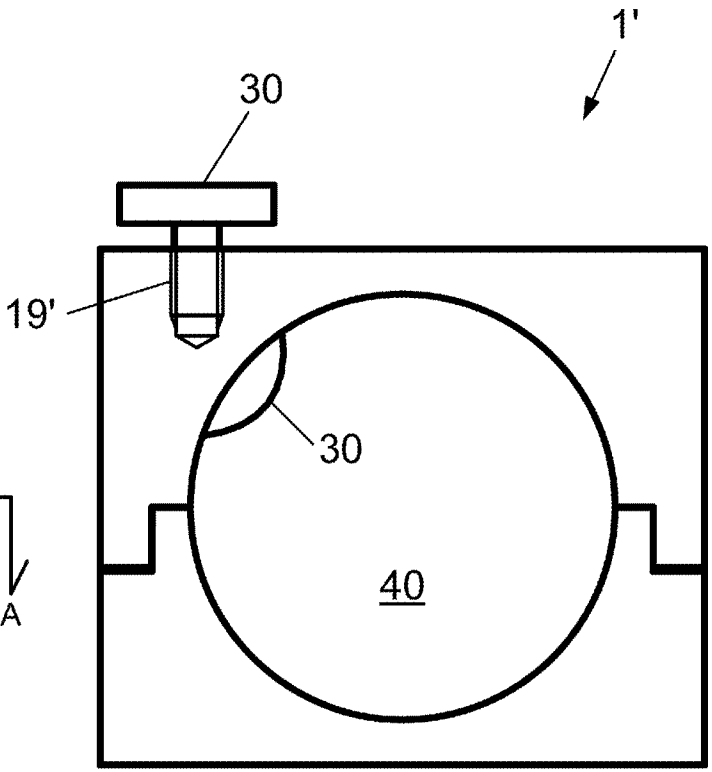
FIG. 8B shows a cross-sectional view of the modified cooling device of FIG. 8A, the cross-section taken along line A-A in FIG. 8A, and with an optional knob further attached to the modified cooling device.
Figure 8A:
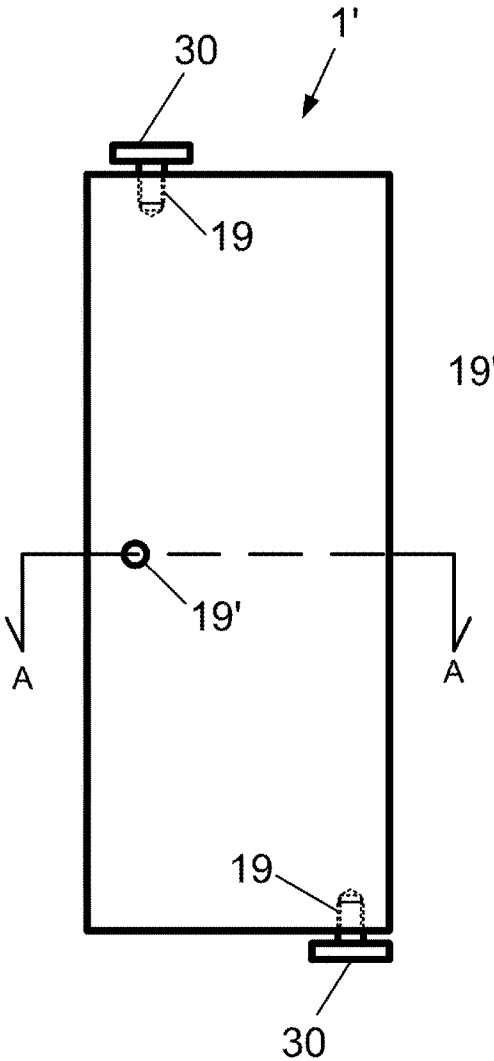
FIG. 8A shows a top view of a modified cooling device according to another embodiment of the invention.

FIGS. 8A and 8B show a slightly modified cooling device 1' which includes an additional bore 19' compared to the first cooling device 1. Parts and portions of the modified cooling device 1' that are identical to the first cooling device 1 are marked with the same reference numbers, and the descriptions thereof will not be repeated. The additional bore 19' in the embodiment shown in FIGS. 8A and 8B is located approximately halfway along the length of the first body, and offset to one side relative to the chamber 40. As can be seen in FIG. 8B, placement of the threaded bore 19' to one side allows the bore to extend into a solid portion of the body, without extending into the chamber 40. A knob 30 that is connected to the additional bore 19' may, for example, facilitate easier separation of the first body from the second body, for example, by providing a handle to lift the first body up and away from the second body.

Referring back to the recesses 16, 26 of the first embodiment, alternative embodiments have also been contemplated. For example, in an alternative arrangement, the recesses on the first body may instead be formed on the outside of the first body, while the recesses on the second body may instead be formed inside and communicate with the cylindrical recess. In such an arrangement, the depth of the recesses on the second body may be shorter than the depth of the recesses on the first body, to facilitate a closer merging of the first and second bodies at the chamber 40, while maintaining the gap on the outside of the cooling device.

Figure 9A:
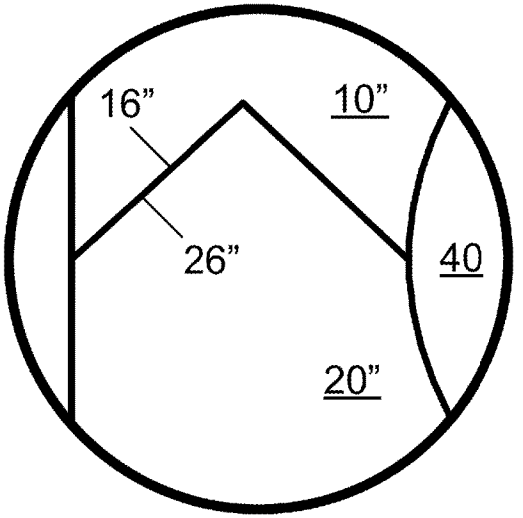
FIGS. 9A to 9C show close-up views of modified engagements between top and bottom pieces of a cooling device according to further embodiments of the invention.
Figure 9B:
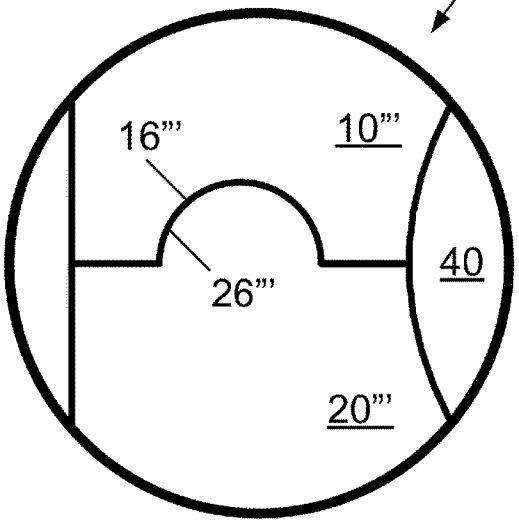
Figure 9C:
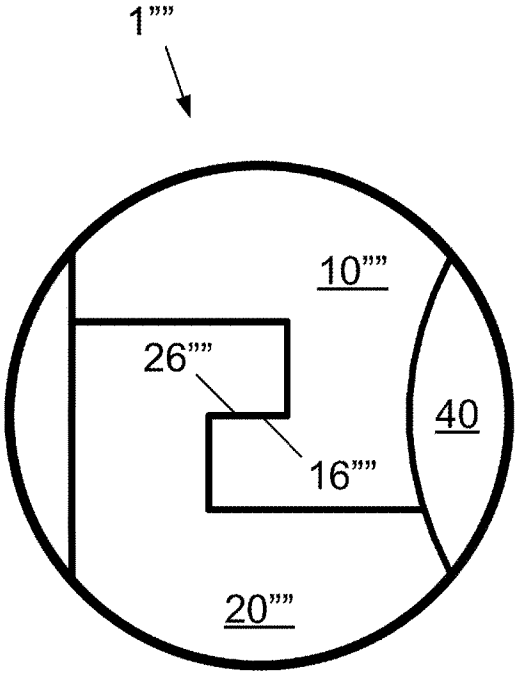

FIGS. 9A to 9C show still further possible modifications to the engagement regions of the first embodiment of the cooling device 1. Again here, parts and portions of the modified cooling devices 1", 1", and 1" that are identical to the first cooling device 1 are marked with the same reference numbers, and the descriptions thereof will not be repeated. Each of FIGS. 9A to 9C show cross-sectional views that include alternative engagement regions instead of the recesses 16, 26 as shown in the first embodiment. First, the cooling device 1" shown in FIG. 9A includes a first body 10" with a first engagement portion 16" that includes a recess with a triangular cross-section, and a second body 20" with a second engagement portion 16" that includes a projection with a corresponding triangular cross-section. In this manner, an alternative form-fit connection can be provided, while avoiding, for example, vertical faces which may be prone to getting stuck due to various factors such as reduced manufacturing tolerances, part expansion from temperature changes, and various other factors. The cooling device 1''' shown in FIG. 9B provides a still further modified engagement region, including a first body 10''' with a flat end face provided with a circular or cylindrical groove 16", and a second body 20''' with a mating circular or cylindrical projection 26''' that is configured to extend into the groove 16''' to provide another alternative form-fit connection. FIG. 9C provides yet another alternative cooling device 1'''' with another variation of engagement region. In FIG. 9C, the first body 10'''' and the second body 20'''' have complementary interlocking parts 16'''', 26'''', which prevent vertical assembly and separation. The parts 16'''', 26'''' include interlocking tongues, which may limit assembly of the cooling device 1'''' to only lateral sliding, i.e., by sliding the first body 10'''' relative to the second body 20'''' along a longitudinal direction of the cooling device 1''''. This embodiment may be advantageous, for example, by providing a stronger or more secure interlocking between the first and second bodies 10'''', 20''''. Other similar or different arrangements of engagement portions may further be provided without departing from the spirit or scope of the invention.

Still other modifications can further be applied. For example, the sides and/or top of the cooling device may be modified to include ridges, other textures, or otherwise increase surface area, if additional tests find that such increased surface area between the cooling device and the surrounding air will accelerate rechilling time of the cooling device, for example, after an initial use.

At least the first and second bodies of the cooling device, as well as other portions of the cooling device, may be manufactured using solid aluminum or aluminum alloy. For example, some prototypes on which tests were conducted were constructed using 6061 aluminum alloy. The aluminum parts may have anodized, polished, and/or dyed surfaces, and may be manufactured, for example, through an extrusion process. The respective parts can be made of the same materials and/or alloys, or of different materials from one another. Anodization of the surface of the bodies of the cooling device will improve durability of the cooling device by creating a thin layer of anodized aluminum which will be harder than the underlying aluminum or aluminum alloy, as well as potentially improve appearance, for example, by more easily facilitating coloring and/or labeling of the bodies, for example, with corporate logos. Meanwhile, manufacturing via extrusion yielded the most reliable and smooth finish for the cylindrical recesses, which are key to maximizing contact with a container of an appropriate size. The surfaces of the cylindrical recesses should be as smooth as possible to minimize any imperfections that might lead to micro air pockets and/or otherwise reduce contact area, which would consequently slow down heat transfer. Furthermore, even after extrusion, the surfaces of at least the cylindrical channels should be polished or otherwise smoothed out to maximize contact area with a suitable container.

Figure 17:
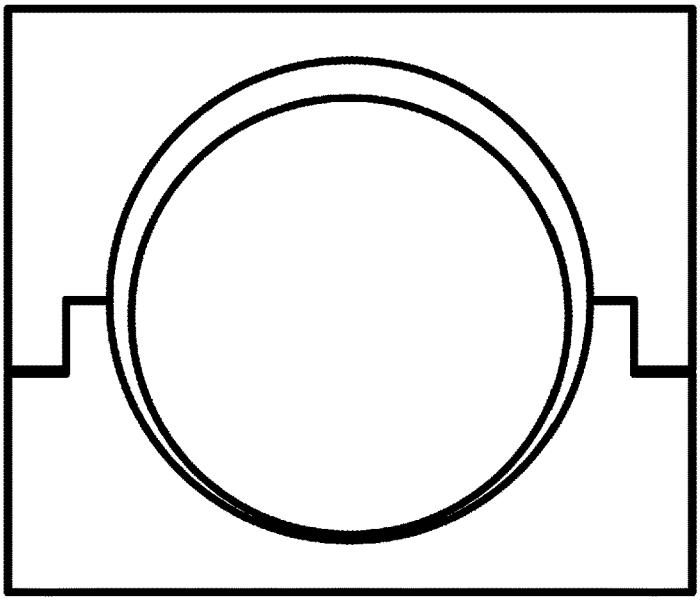
FIGS. 17 and 18 show front views of an exemplary cooling device holding mis-sized and/or mis-shaped containers.
Figure 18:
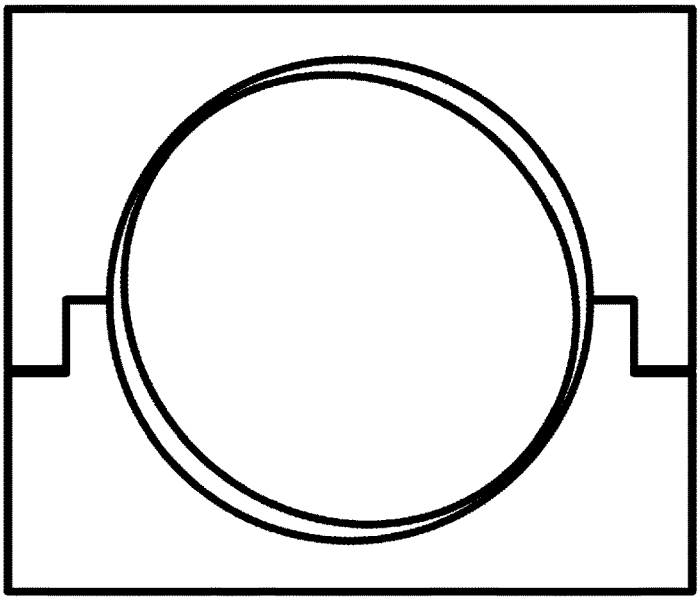

In operation, the first body can be lifted or otherwise manipulated to provide clearance for a soda can or other beverage container to be inserted into the chamber. The first body can then be moved back into position atop the second body to close the chamber around the sides of the beverage container and to closely envelop the container. When two objects with different temperatures are placed in contact with one another, the heat transfer occurs at the surface area where the two objects make contact. By maximizing surface area contact with a standard soda can or other similarly sized container by constructing the cylindrical chamber 40 at the same size of 66 mm diameter such that the chamber closely envelops the container, heat transfer between the cooling device and the container can also be maximized. In this example, about 70% to 80% of the surface area of a standard 12 ounce soda can will be in direct contact with the cooling device, when taking into account, for example, the ends of the can and tapered transitions. In contrast, in cases where the shape of the chamber does not exactly match the diameter of the container, the contact surface would be drastically lower, leading to reduced heat transfer between the container and the cooling device. As can be seen in particular in FIGS. 17 and 18, examples of mis-sized and/or mis-shaped containers held in the cooling device will have much less contact area between the cooling device and the container, leading to much slower performance. A properly sized container will maximize its contact area with the cooling device along its entire circumference. In contrast, as seen in FIG. 17, a cylindrical container that is too small will only have a single line of contact that extends along the length of the cooling device (i.e., point contact viewed in cross-section). Meanwhile, FIG. 18 shows an example with a slightly misshapen container, for example, with a deformed or otherwise elliptical cross-section instead of a circular cross-section, in which case there may only be two lines of contact along the length of the cooling device. Similarly, if the container is too large (not shown), the cooling device may not close properly, and contact may only occur at the corners of the respective bodies, with the corners of the bodies digging into the container. In all these cases, the air gaps between the container and the cooling device will drastically reduce thermal conductivity between the cooling device and the container, thereby significantly increasing cooling times.

Certain common metals have strong thermal conductivity, such as copper, aluminum, and zinc. Of the materials tested, aluminum was chosen as the preferred base material because of its strong conductive properties, and also because of its availability, density, recyclability, durability, cost, production and manufacturing capabilities, and safety. Aluminum was also shown to tolerate and withstand both the cold environment in the freezer as well as high humidity environments well during testing. In other embodiments, another material with relatively strong thermal conductivity can be used instead, for example, copper or zinc as mentioned above.

To add further specificity with respect to materials that can be used, a tradeoff between thermal conductivity and other factors must be considered. For example, copper, silver, and gold all have higher thermal conductivity than aluminum, but are all much more expensive than aluminum. Other materials may be harder and therefore more difficult to manufacture. Or other factors may also contribute to the material or materials selected. Even amongst aluminum, although pure aluminum may have a higher thermal conductivity than, for example, 6061 aluminum alloy, 6061 aluminum alloy may be more readily available and/or easier to manufacture the desired shapes via extrusion in comparison. And through testing, 6061 aluminum alloy yielded acceptably rapid cooling results, discussed in greater detail below. Therefore, it should be understood that while various different materials can be used to construct a cooling device without departing from the spirit or scope of the invention, selecting materials with thermal conductivities that deviate too much from that of 6061 aluminum alloy may unacceptably sacrifice cooling times and/or other performance metrics or properties. As such, a certain performance threshold should still be expected from the material selected.

As an example, 6061 aluminum alloys generally have thermal conductivity of about 150 $Wm^{-1}K^{-1}$ at 0 degrees Celsius or 32 degrees Fahrenheit, which increases slightly at lower temperatures and decreases slightly at higher temperatures. Therefore, in our typical operating temperature ranges, which will usually start lower at about 0 degrees Fahrenheit in a conventional freezer, the thermal conductivity of 6061 aluminum alloy will also be at around 150 $Wm^{-1}K^{-1}$, if not slightly higher. Meanwhile, pure aluminum has a higher thermal conductivity, for example, around 250 $Wm^{-1}K^{-1}$ in the same temperature ranges, and would yield faster cooling results, but may be less desirable than 6061 aluminum alloy due to other factors, as mentioned above. At a lower thermal conductivity range, zinc has a thermal conductivity of around 115 $Wm^{-1}K^{-1}$ in the same temperature ranges, and could be considered as a possible alternative material without sacrificing too much in terms of performance, but any material with even lower thermal conductivity may, as a consequence, slow cooling times too significantly and affect performance too undesirably. As a further data point, tin or alloys including primarily tin could also be considered, but with the thermal conductivity of tin being in the 75 $Wm^{-1}K^{-1}$ range, cooling devices constructed using tin may increase cooling times by twofold or more when compared to those constructed using 6061 aluminum alloy. Such reduced performance may be acceptable in some cases and for some consumers, but may not be for others. Therefore, while the material or materials selected for constructing cooling devices according to embodiments of the invention will most preferably be about 150 $Wm^{-1}K^{-1}$ or higher in the typical operating temperature range (i.e., based on the properties of 6061 aluminum alloy), the primary material or materials selected should at the very least have a thermal conductivity above about 75 $Wm^{-1}K^{-1}$ in the typical operating temperature range, and more preferably above about 100 $Wm^{-1}K^{-1}$ in the typical operating temperature range.

Furthermore, another important factor or variable in thermal conduction is the heat transfer coefficient of materials that are in contact with one another. Meanwhile, fluid held inside the container will generally have far lower thermal conductivity than the surrounding aluminum. These variations in thermal conductivity create a rate-limiting variable in the cooling system. When the walls of the beverage container are made of aluminum (as nearly all standard soda cans are), and the cooling device is made of aluminum as well, the heat transfer between the cooling device and the fluid held in the container increases because the similar material properties between the container and the cooling device allow the container and the cooling device to in effect work together to facilitate more rapid heat transfer away from the fluid into the cooling device (i.e., as if there was no layer between the cooling device and the fluid held in the container), while the colder air in the freezer simultaneously and continuously cools the cooling device as well. In contrast, if the container was made of glass or other material with relatively lower thermal conductivity, the heat from the fluid would first have to be transferred to the intermediate glass layer before being transferred from the glass to the aluminum. Similarly, with the first and second bodies or blocks made of solid aluminum or aluminum alloy, rather than for example, having non-aluminum internal components, or made hollow with internal air pockets or chambers, the solid aluminum or aluminum alloy will be able to facilitate faster heat transfer from the fluid or liquid to the cooling device.

Other factors will also affect the rate of heat transfer. For example, the relative masses of the respective objects will also affect the speed of cooling of a held fluid/liquid. The larger the mass of the cooling device, the more heat that can be absorbed. The shape of the cooling device has been designed to maximize the surface area while minimizing cooling time, and the size/mass of the cooling device was determined by the target temperature of a beverage at the end of a given chilling time period. In other words, the size/thickness of the cooling device was selected to be large enough to rapidly chill a certain volume of liquid/fluid by a certain amount (i.e., by an expected target temperature) in an efficient manner, while not being too large so as to facilitate easier handling and storage, as well as to keep material costs down, since half or more of the manufacturing costs of the cooling device may be attributable to the raw materials for forming the main bodies of the cooling device. The overall dimensions of the cooling device can in one embodiment be selected to chill a container sized to maximize contact area with the cooling device and capable of holding a standard bottle of white wine (e.g., 750 mL) from room temperature (e.g., about 72 or 73 degrees Fahrenheit) by approximately 25 degrees to 48 degrees Fahrenheit, which is in the range of an ideal drinking temperature of white wine, in about 3 to 5 minutes. To increase contact area between the cooling device and the container and thereby improve heat transfer, the wine or other beverage is typically first transferred into a cylindrical container with the same diameter as the chamber of the cooling device (e.g., 66 mm), before being placed in the chamber of the cooling device. Depending on the dimensions of the container, the type of beverage being cooled, and other factors, in some embodiments, the cooling device may be capable of chilling a standard bottle of white wine to 48 degrees Fahrenheit in less than 3 minutes, while in others, it may take longer than 5 minutes to reach the same ideal temperature. While the depth of the bottle and the liquid held therein will also affect chilling times (in other words, if the bottle is wider, the center portions of the liquid will take longer to chill), and a narrower diameter channel and chamber would lead to faster cooling times, the selected diameter of 66 mm for the chamber allows for use with the most widely used standard 12 ounce aluminum soda and beverage cans, and so the 66 mm diameter cylindrical chamber was selected for its more universal compatibility.

Another beneficial property of aluminum is its ability to quickly rechill after an initial use, so that reuse will not be delayed too much by the cooling device taking too long to reduce its core temperature down to a serviceable level. In instances where the cooling device was used to chill a first container in about 3 to 5 minutes and then was used to chill a second container immediately after the first usage, cooling times to cool the second container to the same extent may take two to three times as long, for example, approximately 10 to 15 minutes, while a third consecutive usage may prolong the cooling time even more, for example, five to ten times as long, for example, to about 30 minutes. If the cooling device were allowed to cool at least partially on its own between usages, those latter cooling times could be further reduced.

In other arrangements, there may be other target temperatures, volumes of liquid to chill, or type of liquid, among other factors, which may result in different chilling times and/or call for a differently sized or shaped cooling device for similar results. For example, the temperature of a standard 12 ounce can of soda drops by approximately 25 degrees Fahrenheit using the same cooling device even more rapidly, in about 2 to 3 minutes. The starting core temperature of the cooling device will also affect cooling times. The starting core temperature of the cooling device may be affected by factors such as freezer settings, consecutive usage of the cooling device (e.g., if the cooling device is used to chill a second container prior to allowing the cooling device to cool down to its initial temperature), and other factors. For example, if the core temperature of the cooling device is 0 degrees Fahrenheit or lower when a soda can is placed in it, it will take 2 minutes or less to drop the temperature of the soda can by 25 degrees Fahrenheit. In contrast, if the core temperature of the cooling device initially is at 10 degrees Fahrenheit, it may take 3 minutes or more to chill the same soda can by 25 degrees Fahrenheit. And if the core temperature of the cooling device initially is at or around 15 degrees Fahrenheit, it may take 5 minutes or more to chill the same soda can by 25 degrees Fahrenheit. In practice, even in a freezer set at 0 degrees Fahrenheit, the cooling device may begin with a slightly elevated initial core temperature, for example, 5 degrees Fahrenheit, due to the rapid warming of the cooling device and freezer environment even in the short amount of time the freezer door is opened and a beverage container is loaded into the cooling device. Due to such factors, typical cooling even in a freezer set at 0 degrees Fahrenheit may remain above 2 minutes, for example, between 2 and 3 minutes. The dimensions of the cooling device may further be selected such that two standard 12 ounce soda or beverage cans can be placed next to each other inside the chamber of the cooling device. Due to the additional mass of the beverages to be chilled (i.e., 24 ounces compared to 12 ounces), operation in this manner may increase cooling times, for example, to approximately 6 minutes for a 25 degree Fahrenheit drop in temperature from room temperature for both of the beverages. Other factors, such as the composition of the liquid being chilled, may also affect cooling times. For example, wine may contain about 14% ethanol, which transfers heat less efficiently than other liquids such as water, which will cause chilling of wine to be about 10% slower than chilling water.

Upon first operation, it may take about 3 hours initially (and potentially up to 6 hours) for a cooling device at room temperature to reach a desired target core temperature of 0 to 5 degrees Fahrenheit. The cooling device can be placed in the freezer in a closed configuration, with the first and second bodies already assembled to one another, to avoid having to handle and assemble the bodies once chilled, particularly when shelf space does not allow for easy vertical assembly of the two bodies to one another. In other embodiments, it may be beneficial to initially place the cooling device in the freezer in an open configuration (i.e., not assembled together), in order to avoid any condensation between the parts essentially freezing the parts together when the parts are initially cooled from room temperature. Once in the freezer, it will take much less time for the cooling device to return to its optimal starting temperature after usage, since the temperature the cooling device reaches and has to be rechilled from after each use will be much lower than room temperature.

To effectuate the above results, the cooling device is designed to be held in a freezer compartment of a conventional kitchen refrigerator, which will generally allow the core temperature of the cooling device to be held between 0 and 10 degrees Fahrenheit. As discussed above, when a beverage container or other fluid container is placed inside the chamber of the cooling device, a thermal equilibration process immediately begins, and the lower temperature of the cooling device and the higher temperature of the container and the fluid immediately begin to converge, which will result in the cooling device rapidly drawing heat from the fluid inside the container back to itself, and thereby rapidly lowering the temperature of the container and the fluid held inside while raising the temperature of the cooling device surrounding the container.

Different designs were contemplated to keep the two halves of the cooling device in place and stable when in a closed position, while also allowing for ease of use and manipulation when opening and/or otherwise loading or unloading a container to be held in the cooling device. The ledged design shown in the first embodiment in FIGS. 1 to 7 appeared to be the most versatile and easy to use. For example, when placed on a shelf in an upright freezer, there may be limited room to lift the first body away from the second body, and so sliding of the first body and/or an inserted container towards the user may be more desired in such an arrangement. The ledged design allowed for the easiest sliding capability between the first and second bodies. To insert a container, the first body could be lifted slightly with one hand to allow clearance for a container to be placed in the chamber. For removal, the first body can be lifted, and if easier, can also be slid towards the user, where as described above, the knob on the rear face of the first body would act as a backstop to also urge the container towards the user as well. Sliding towards the user may not always be necessary however, for example, if a bottle or can with a neck having a reduced diameter is held in the cooling device, then lifting the first body may provide enough clearance to easily access and grab the neck of the bottle or can to remove the bottle from the cooling device without further manipulation of the cooling device. In some embodiments, since a reduced diameter neck may not directly contact the cooling device anyway, the bottle may be held in the cooling device with the neck already sticking out and away from the front faces of the first and second bodies, in which case, a user may even be able to pull the bottle away from and out of the cooling device without directly handling the cooling device at all.

The specific dimensions of the cooling device can be adjusted based on the desired performance and other specifications associated with the intended use of the cooling device, and embodiments of the invention should not be limited to specific dimensions, so long as the dimensions selected are capable of cooling a desired beverage or other liquid at a specific volume by a specific amount in a given amount of time.

For example, an exemplary embodiment discussed above should have the ability to chill either a beverage in a standard 12 ounce aluminum can by 25 degrees Fahrenheit in about 2 minutes, or a 750 ml bottle of wine held in a 66 mm diameter cylindrical container by the same 25 degrees Fahrenheit in about 5 minutes (e.g., about twice as long as it takes to chill a 12 ounce beverage, primarily due to the increased volume). To this effect, the cooling device discussed in FIGS. 1-7 has, as previously discussed, an inner cylindrical chamber with a 66 mm diameter to match the size of a standard 12 ounce aluminum beverage can. The length of the cooling device measured from the front face 13 to the back face 18 is 23.5 cm (e.g., sufficiently long to be able to accommodate two standard 12 ounce beverage cans back-to-back in the cooling device at the same time), while a width of the cooling device measured between the two side faces 12 is 9.4 cm. A height of the cooling device when the first and second bodies are assembled together, measured from the outer surface 11 of the first body 10 to the outer surface 21 of the second body 20, is 8 cm. This arrangement provides for a volume of the chamber to be about 805 mL or cubic centimeters (cc), which would be sufficient to house a container holding 750 ml of wine for example, while a total volume of aluminum of the cooling device between the first and second bodies would be approximately 943.5 cc. With the density of 6061 aluminum alloy being about 2.7 g/cc, the total weight of the cooling device (i.e., the first and second bodies combined) would be about 5.62 pounds.

A height or depth of the groove 16 formed on the first body 10 may be slightly shorter than a height or depth of the groove 26 formed on the second body 20, to allow for some clearance between the inner face 14 of the first body 10 and the ledge 27 of the second body 20. This arrangement will also ensure a closer connection and abutment between the inner face 24 of the second body 20 and the abutment 17 of the first body adjacent the chamber 40, to reduce or prevent gaps forming between the first and second bodies 10, 20 at the chamber 40 when the first and second bodies 10, 20 are assembled together, and thereby maximize contact area with a container held in the chamber 40. In the exemplary embodiment being discussed, the height of the groove 16 may be 9.5 mm, while the height of the groove 26 may be 10 mm. Meanwhile, the depth of the abutment 17 of the first body 10 and the complementary surface at the inner face 24 of the second body 20 may have 6 mm widths, while the depth of the ledge 27 of the second body 20 and the complementary surface at the inner face 14 of the first body 10 may have 8 mm widths. In some embodiments, a further internal gap may be provided to take into account ice buildup, material expansion, and other factors which may inhibit relative movement between the first and second bodies. Such gap may be realized, for example, between the vertical walls of the grooves/recesses 16, 26, where for example, the width of the abutment 17 is formed to be slightly larger, for example, 6.5 mm, while the corresponding width of the remaining portion of the inner face 24 of the second body 20 remains at 6 mm. To reduce height of the overall cooling device, a minimum thickness of the first and second bodies measured between the bottom of the respective cylindrical recesses 15, 25, and their corresponding outer surfaces 11, 21, may be 7 mm. As such, a total height of the second body may be 40 mm (i.e., 33 mm depth/radius of the cylindrical recess 25 plus 7 mm thickness), while a total height of the first body may be 49.5 mm (i.e., 33 mm depth/radius of the cylindrical recess 15 plus 7 mm thickness plus 9.5 mm height of the additional projection at either side of the cylindrical recess. And when assembled, the combined height of the first and second bodies may be 80 mm, including a 0.5 mm gap between the first and second bodies between the respective side surfaces. A width of the cooling device may be slightly wider, at 94 mm (i.e., 66 total diameter of the chamber plus width of two 6 mm recesses plus width of two 8 mm recesses). As noted above, these measurements are exemplary and tested to optimize cooling of the previously identified volumes of beverages and their corresponding containers. Performance with differently sized containers and/or different liquids, among other variables, may be optimized based on other cooling device measurements, and as such, the invention should not be limited to the exact measurements described above.

In the exemplary design, the first body is constructed to be larger and heavier than the second body, due for example, to the projecting ledge of the first body extending away from the halfway point of the cylindrical recess towards the second body, while the recess of the second body is cut away from the outside of the second body. A heavier first body or top half of the cooling device may assist in the first body weighing or squeezing down on an inserted container more effectively to remove any air gaps or other space therebetween. Some embodiments of cooling devices, like the above described embodiment, may further be constructed with integrated gaps on the outside of the device to increase tolerances when the first and second bodies are assembled together. The gaps will also allow for some ice or frost buildup therein, without preventing full closure or assembly of the first and second bodies to one another, and/or may improve sliding or gliding between the first and second bodies during loading and unloading.

Figure 10:
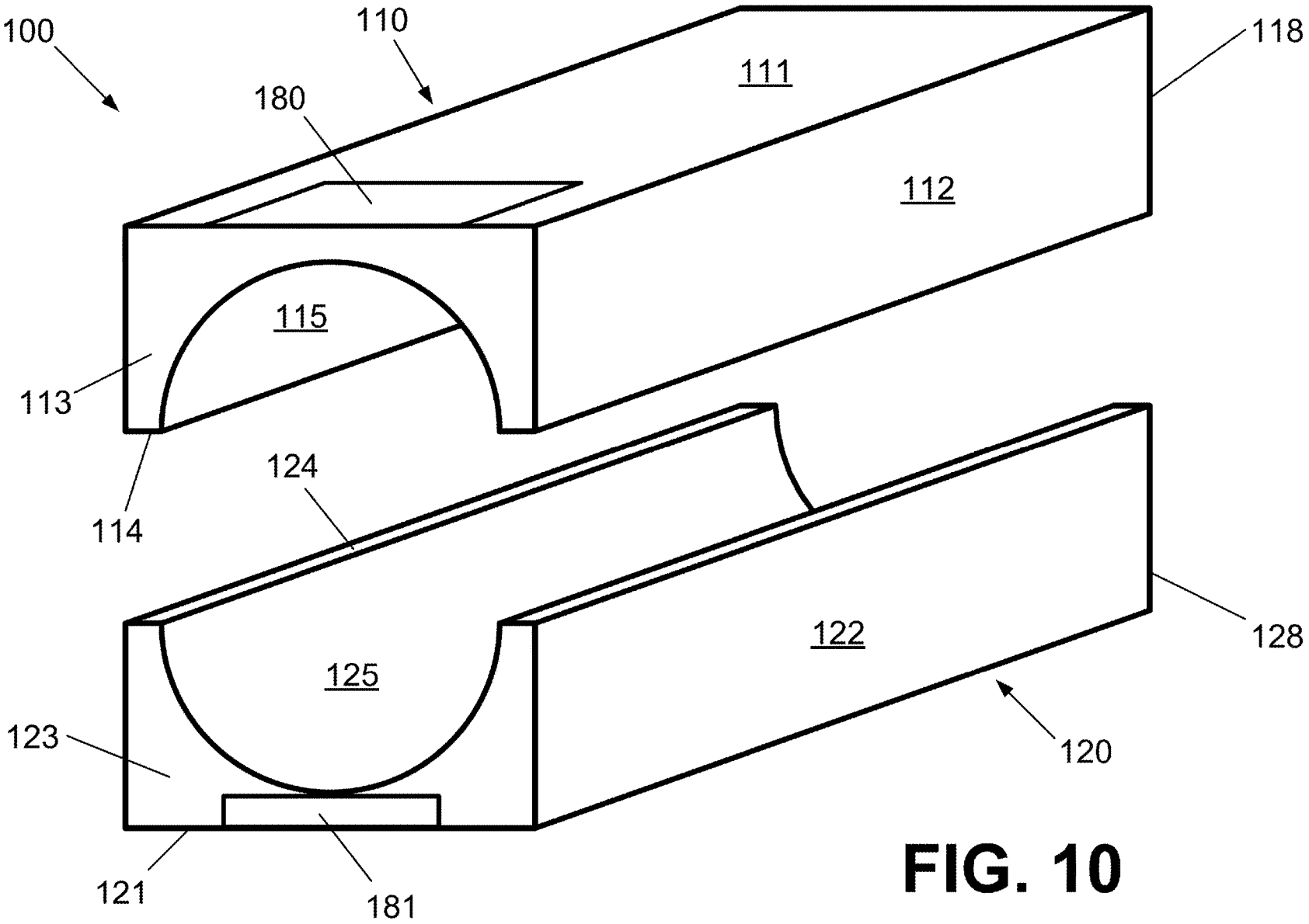
FIG. 10 shows a perspective view from a front of a cooling device according to a second embodiment of the invention in an unassembled state.
Figure 11:
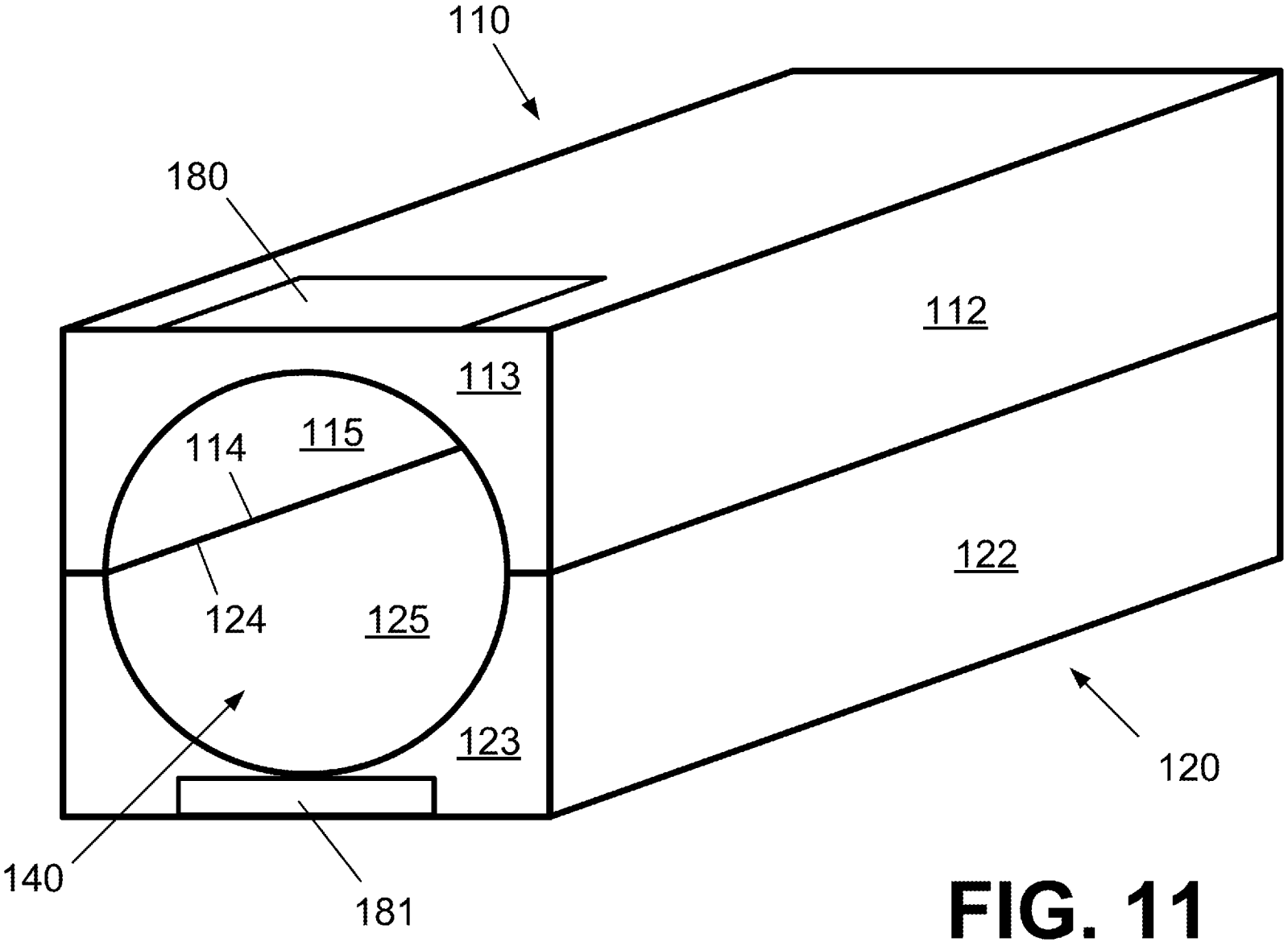
FIG. 11 shows the perspective view from the front of the cooling device of FIG. 10 in an assembled state.

FIGS. 10 and 11 show a cooling device 100 according to a second embodiment of the invention. The general structure of the cooling device 100 according to the second embodiment is simpler than the cooling device 1 according to the first embodiment. The second cooling device also has a first or top body 110 and a second or bottom body 120. The first body 110 includes an outer face or surface 111, two side faces or surfaces 112, a front face or surface 113, an inner face or surface 114, and a back face or surface 118. Similarly, the second body 120 includes an outer face or surface 121, two side faces or surfaces 122, a front face or surface 123, an inner face or surface 124, and a back face or surface 128. When assembled, the respective inner surfaces 114, 124 of the first and second bodies 110, 120 are configured to face one another. A cylindrical recess 115 is formed into the inner surface 114 of the first body 110, and a similar (and in some cases identical) cylindrical recess 125 is formed into the inner surface 124 of the second body 120. The remaining portions of the inner surfaces 114, 124 may simply be flat, and configured to meet together in a simple manner to form an inner cylindrical cylinder 140, which may like in the first embodiment, be dimensioned with a 66 mm diameter, in order to receive and closely envelop a standard 12 ounce beverage can. The first and second bodies may further have additional features, such as a projection and groove arrangement (not shown), in order to hold the parts together in a desired manner when assembled, and to avoid shifting of the parts and consequently misshaping of the chamber 40.

The structure of the cooling device 100 may be such that the dimensions of the first and second bodies 110, 120 are identical, symmetrical, or otherwise substantially the same in this embodiment, which should simplify manufacturing costs. Furthermore, while it was seen that in the first embodiment cooling device 1 in FIGS. 1-7, a width of the device measured from side surface to side surface is greater than a combined height of the cooling device 1 when the first and second bodies are assembled, with the increased width attributable to facilitating the added ledges at the sides of the first and second bodies, there may not be such a difference in dimensions in the cooling device 100. Rather, a width of the each of the first and second bodies 110, 120 of the cooling device 110 may be reduced such that the width and the height of the assembled cooling device may be identical or substantially the same, with for example, a square-shaped cross-section, to further reduce material and consequently reduce costs as well. Such a reduced width device may also be easier to fit inside a freezer for storage or use, and may further be lighter and consequently easier to handle. Upon testing, it was found that so long as the cooling device included about 4 pounds or more of total aluminum, acceptable cooling properties of an inserted 750 mL container of beverage were observed.

Optionally, while not shown, the cooling device 100 according to the second embodiment may also include attachable knobs like in the first embodiment, to facilitate easier handling and manipulation of the cooling device 100. In still other embodiments, the cooling device 100 may further include one or more displays at certain locations on the cooling device 100. For example, a first display 180 may be located on the outer face 111 of the first body 110, and may for example, provide a timer function to identify a time or countdown of time with respect to how long a container has been held in the chamber 140. Other embodiments may show other information, such as a temperature. The display 180 may be positioned close to the front face 113, so that it is more visible to a user when the cooling device 100 is held on a shelf in a freezer. Another alternative display 181 may, for example, be positioned on the second body 120, for example, on the front face 124 and just below the cylindrical recess 125. The display 181 may also provide temperature information, timer information, both, or other useful information associated with the cooling device or with a beverage being chilled therein. The placement of the display 181 may allow for easy viewing without having to move the cooling device 100. In cases where a timer is provided, a simple timer with predefined intervals (e.g., 2, 3, 5, and 10 minutes) may be provided to alert a user, e.g., of how long their beverage has been in the cooling device, and/or as a safeguard to alert the user that their beverage is still in the cooling device. In cases where a thermometer or other temperature scale is incorporated, a simple analog thermometer with a thin probe extending into the core of the first or second body may be sufficient to show an accurate core temperature of the cooling device, and whether the cooling device is sufficiently prepared for cooling a beverage container. Other displays and/or other controls may be integrated into the cooling device according to either the first or second embodiment, as well as into the later described embodiments, in other ways as well without departing from the spirit or scope of the invention.

Furthermore, in some embodiments, it may be advantageous to only employ half of the cooling device 100, for example, only the second body 120, without the first body 110, where a corresponding container is simply placed into cylindrical recess 125 in an open configuration. While cooling times may be longer with such an arrangement, there may be other benefits, for example, the ability to simultaneously chill more beverages at the same time with a single purchased product (i.e., the first and second bodies can be used simultaneously to chill different containers), or may be useful in situations with very limited vertical clearance, for example, where there may not be enough vertical space to fit first body 110 over second body 120. However, in addition to the drawback of slower cooling times, another observed deficiency with such an open arrangement was a large temperature gradient between different parts of the container, for example, those portions in contact with the cooling device compared with those portions which were not in contact, leading to inefficiencies in cooling only certain portions of the liquid held in the container while not cooling other portions, and consequently resulting in noticeable effects to the taste of the partially chilled beverages.

Figure 12:
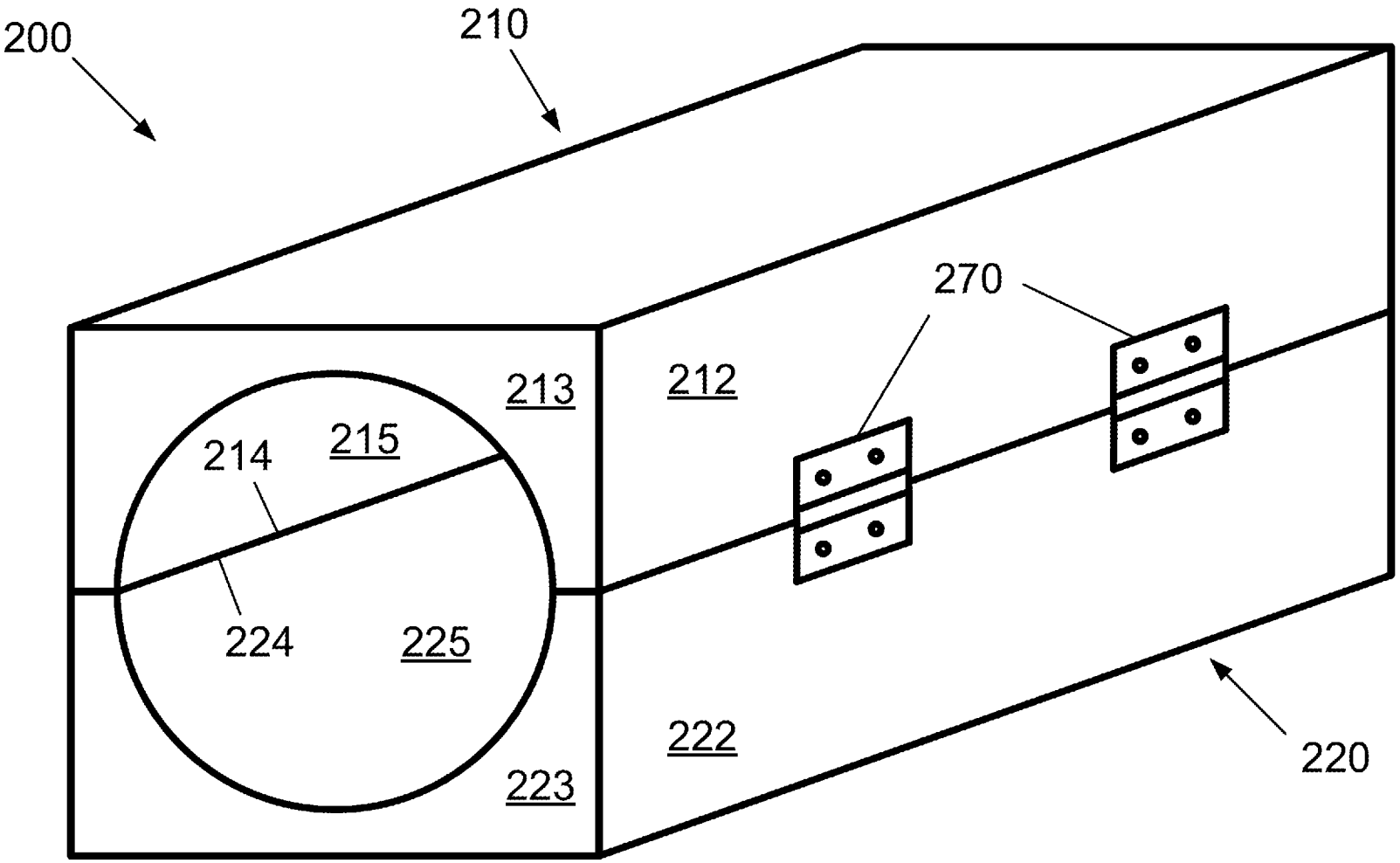
FIG. 12 shows a perspective view from a front of a cooling device according to a third embodiment of the invention in a closed configuration.
Figure 13:
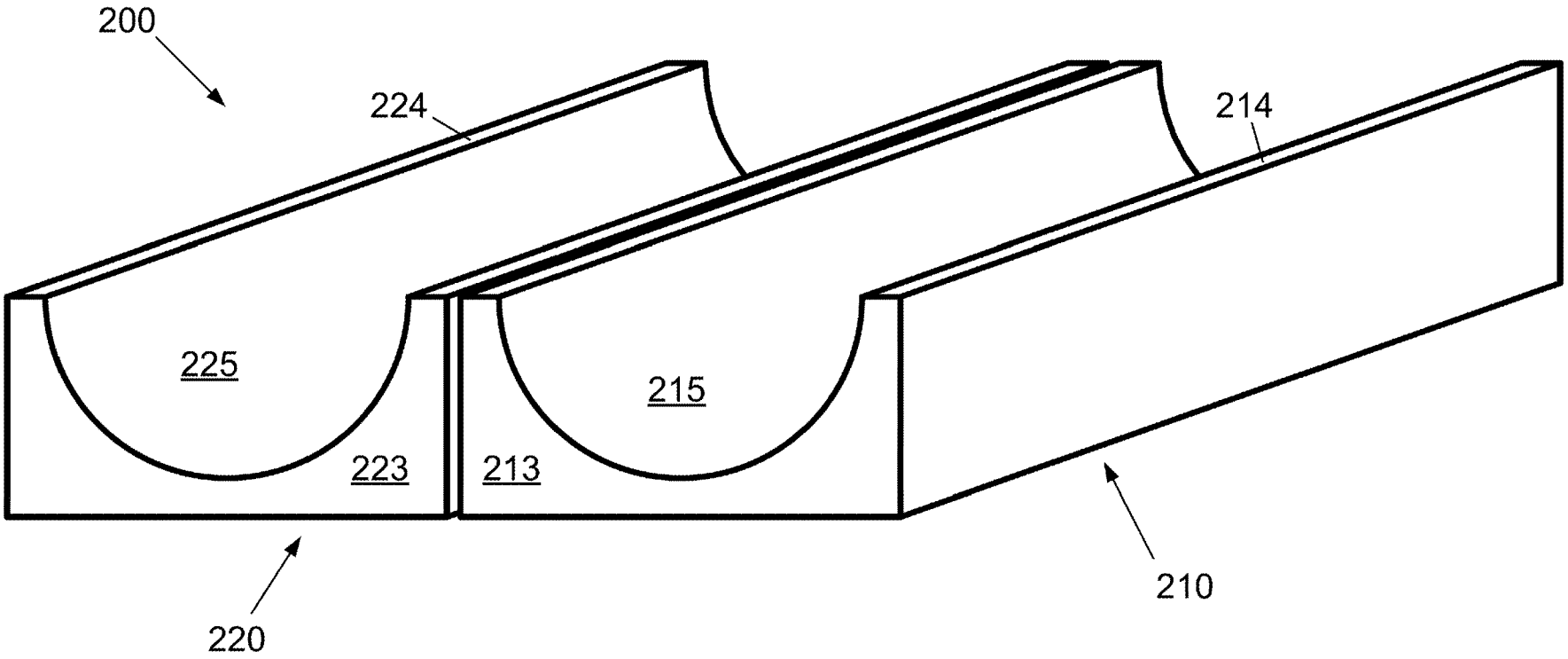
FIG. 13 shows the perspective view from the front of the cooling device of FIG. 12 in an open configuration.

A cooling device 200 according to a third embodiment of the invention is further shown in FIGS. 12 and 13, with FIG. 12 showing a closed configuration and FIG. 13 showing an open configuration. The cooling device 200 according to the third embodiment may have first and second bodies 210, 220 that are similarly dimensioned to the first and second bodies 110, 120 of the second embodiment of the cooling device 100. For example, the first and second bodies 210, 220 may respectively include inner surfaces 214, 224 with cylindrical recesses 215, 225 formed therein which merge together to form an inner chamber capable of tightly enveloping a standard 12 ounce soda can (e.g., with a 66 mm diameter). The chamber may also be similarly open at the front faces 213, 223 of the first and second bodies 210, 220. However, in addition to the features of the second embodiment, the first and second bodies 210, 220 of the cooling device 200 may further be connected via a hinge connection, where one or more hinges 270 are formed on one set of side surfaces 212, 222, to connect the first and second bodies 210, 220 together. The hinged connection provided by hinges 270 may help facilitate easier handling, for example, more consistent opening and closing, and will help hold the first and second bodies 210, 220 together more consistently, such that the cylindrical chamber formed therebetween can be more easily and accurately formed when the first and second bodies 210, 220 are closed together. On the other hand, a hinged connection may also hinder some operation. For example, the cooling device 200 may require removal from a freezer shelf before opening and closing if there is not enough vertical clearance in the freezer to open and close the cooling device 200 in place. Meanwhile, similar to the first and second embodiments, knobs (not shown) may also be attached to some embodiments of a hinged cooling device, to facilitate easier opening, closing, and general handling.

FIGS. 14 to 15B respectively show a bottle and cap that can be used together with the cooling device according to embodiments of the invention. In some cases, the cooling device may be sold together with one or more bottles and caps, and the bottles themselves can be sized and shaped to most optimally work together with the cooling device. Consistent with the embodiments described above, the bottle 300 may be formed with a main body 310 having a thin aluminum wall, and which may have an outer diameter of 66 mm to closely match the 66 mm diameter of the chamber formed in the cooling devices described above. The inner wall of the bottle 300 may be provided with a thin liner, for example, of BPA free epoxy, to reduce direct interaction between the aluminum wall and the fluid held inside the bottle. A height of the body 310 of the bottle may be selected first to fit entirely inside the chamber of the cooling device, while also providing enough space inside to hold at least 750 ml of beverage or other fluid. In this manner, the bottle 300 according to embodiments of the invention can be used to hold a transferred bottle of wine, to more effectively chill the wine as compared to, hypothetically, if the original bottle holding the wine could fit in and was inserted into the chamber of the cooling device instead, due to the increased contact area of the specially sized bottle. Having a dedicated bottle that is accurately sized may also solve the issue of not being able to cool bottles or other containers of beverages that may be too large to fit in a particular cooling device. Some embodiments of bottles may be different sizes, for example, 375 mL (i.e., approximately half the height and therefore half the capacity of a 750 mL volume bottle), so long as the diameters of the various sized bottles remain the same to maximize contact area with the cooling device. In some cases, bottles of different sizes can also be provided together with the cooling device according to embodiments of the invention.

At a top end of the body 310, there may be a reduced width or diameter neck portion 320 for attachment of a cap. The neck portion 320 may be threaded or have another attachment mechanism to allow attachment of the cap in an airtight or otherwise sealed manner to prevent or reduce leakage of any liquid held in the bottle 300. The top of the neck portion 320 may define an opening 330 to provide access to the internal chamber of the bottle 300. The opening may be, for example, 33 mm or greater, but is not limited thereto. In general, the bottles 300 should be manufacturable at very low cost, and can therefore be provided as a kit together with the cooling device, and/or separately at a low cost.

As shown in FIGS. 15A and 15B, a dynamic cap 400 may further be provided. The cap 400 may include one or more of the illustrated components, which may help provide valuable controls or monitoring information to a user. For example, if the cap includes electronics, the cap may include a power button 415 to power up the cap's functionalities. A larger main display 411 may display a current temperature of a beverage or other liquid that is being held in the bottle, while a smaller secondary display 412 may show, for example, a target temperature or a timer, or other useful information. Up and down arrows 413 and 414 may be provided, for example, as controls for increasing or decreasing a target temperature and/or a timer duration. A speaker or other sound emitter 416 may further be provided as an alarm to indicate that a target temperature or time has been reached. And a position indicator mark 417 may further be provided to ensure proper alignment of the cap when assembled to the bottle (not shown), for example, to ensure a proper seal has been reached between the parts to minimize leakage, or when the bottle and cap are held in a cooling device, as described in greater detail below. Additional buttons and/or displays may further be provided as appropriate, for example, a reset button to confirm or reset a particular temperature reading. At an underside of the cap, a temperature probe 418 may extend away from the cap and into the bottle, in order to come into contact with a beverage held in the bottle and provide accurate temperature readings of the housed beverage. The temperature probe may, for example, be approximately 10 cm in length so as to be long enough to ensure contact with a held beverage or liquid, and may be angled, for example, at 10 degrees, relative to a central axis of the cap 400. The cap may include an inner thread or other engagement mechanism to ensure secure and leakproof engagement with the neck portion 320 of the bottle 300. A power source provided for the cap may, for example, be a standard flat or rechargeable battery, for example, rechargeable via a USB port.

Figure 16:
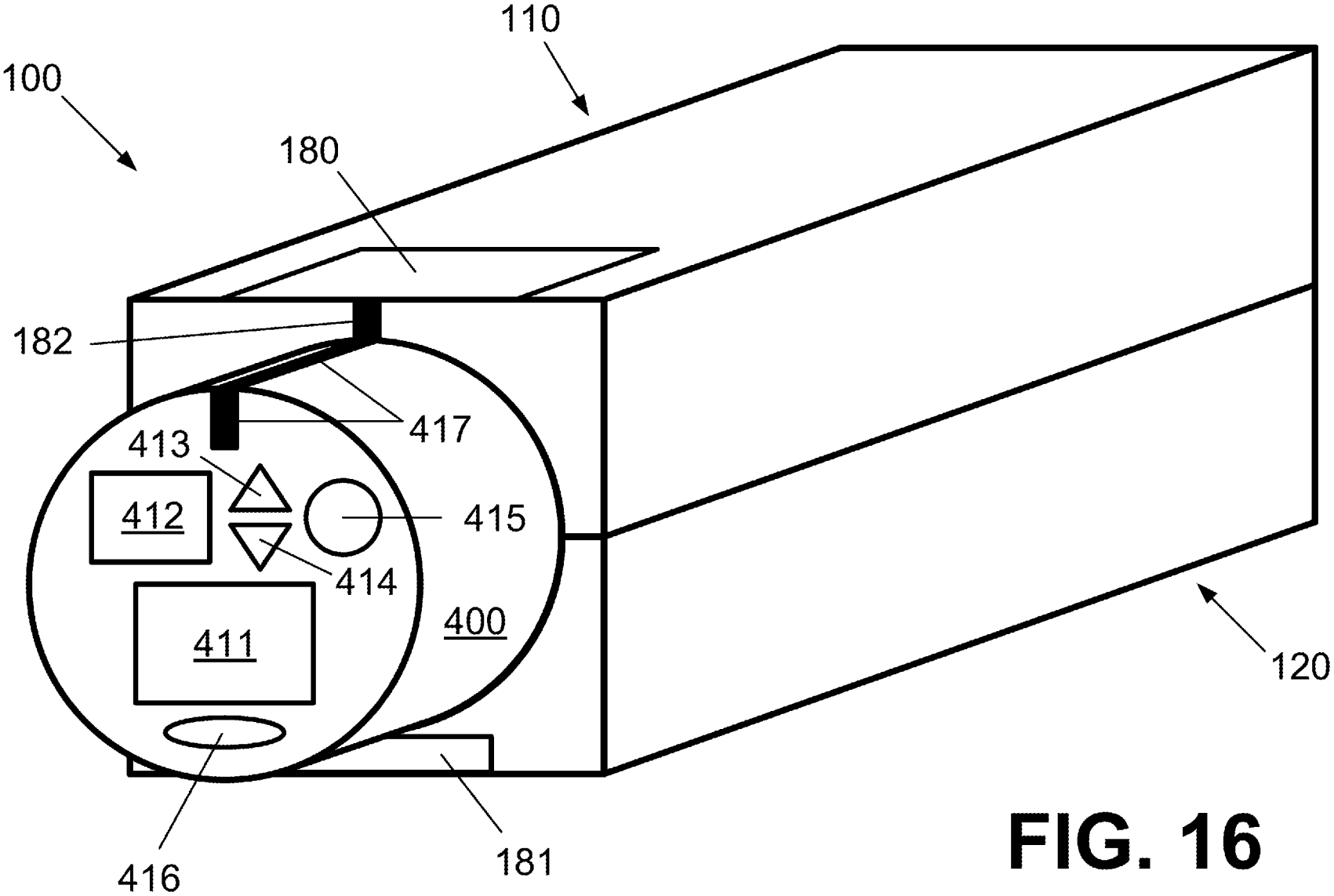
FIG. 16 shows a perspective view from a front of the cooling device shown in FIGS. 10-11 in an assembled state and holding the bottle of FIG. 14 therein with the cap of FIGS. 15A and 15B assembled to the bottle, according to an embodiment of the invention.

FIG. 16 shows an embodiment of a cooling device 100 according to the second embodiment, with a bottle according to the embodiment shown in FIG. 14 inserted into the chamber. Here, the cap 400 is connected to the inserted bottle, where the cap 400 is allowed to extend out of the cooling device to provide easy access to a user. This arrangement allows for easy access to the controls on the cap, and may also provide for an easy grabbing point to assist with insertion into and removal of the bottle from the cooling device. As can be seen in FIG. 16, the controls and displays on the cap 400 are all easily accessible, and the cooling device may further include another position indication marker, for example, as shown at 182, which will allow for proper alignment between the cap/bottle combination and the cooling device, such that, for example, the temperature probe is arranged in a most optimal manner (e.g., angled downward to maximize the probability of immersion of the end of the probe in liquid when the bottle is less than half filled or otherwise not fully filled, to avoid the probe returning a temperature of the air in the bottle instead of the liquid), and/or so that the respective displays on the cooling device and the cap are properly aligned and all visible and/or easily accessible without having to further manipulate the combination. Proper alignment may further provide other unstated benefits as well. In other embodiments, other types of caps or lids may be provided instead of or in addition to cap 400, for example, standard caps or lids that do not provide any auxiliary functionality.

Various other features may further be incorporated into the cooling device design as well. For example, if a beverage container holding a beverage containing carbon dioxide or other carbonation is accidentally left in the cooling device for too long, the container may break, for example, in about 3 hours. While such would not damage the cooling device, it may be inconvenient to clean up. As such, additional alarms may be incorporated into the cooling device, for example, a built-in or remotely connected timer and notification system to remind users to remove a container from the cooling device. Alternatively, additional thermometers to provide more temperature information that work in conjunction with a timer when the temperature of the beverage falls below a certain level may also be provided.

Auxiliary components may further be provided. For example, auxiliary blocks of aluminum that fit together with the cooling device which may further reduce chilling times may be separately sold. Since a greater mass of aluminum will further reduce chilling times, a modular approach with optional add-on pieces of aluminum that can simply be connected above, below, and/or on the sides of an existing cooling device may be offered to consumers who would like to pay more to realize even shorter cooling times for their cooling devices.

Other features may, for example, ease cleaning of the cooling device, for example, to remove a layer of frost or ice that might accumulate on the first and/or second bodies over time, for example, over 0.5 mm which may affect the ability of the cooling device to close properly and consequently reduce the effectiveness of the cooling device. Other frost prevention techniques may further be employed in other embodiments, for example, a non-stick coating can be applied on the surfaces of the cooling device, via spray deposition or otherwise. Furthermore, after cleaning, the cooling device should be free from moisture before being placed back into the freezer, to prevent a layer of ice forming from the moisture. To this effect, a moisture or other operational-based or safety-based sensor may further be provided to ensure that the cooling device is ready to be placed in the freezer and will operate at an optimal level.

Still further modifications may be contemplated. For example, a cooling device with more than two main bodies may be provided without departing from the spirit or scope of the invention. In addition, specific features described with respect to one embodiment may also be incorporated into the other described embodiments, and further combinations can be made, also without departing from the spirit or scope of the invention. And still other combinations and/or modifications can be made as well.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. A cooling device for cooling a fluid, the cooling device comprising:

a first body having a first end, a second end, and a longitudinal axis extending between the first and second ends, the first body comprising an inner face, an outer face, and two side faces connecting the inner and outer faces, wherein the inner face, the outer face, and the side faces extend from the first end to the second end;

a second body having a first end, a second end, and a longitudinal axis extending between the first and second ends, the second body comprising an inner face, an outer face, and two side faces connecting the inner and outer faces, wherein the inner face, the outer face, and the side faces extend from the first end to the second end; and a handle that extends away from a surface of at least one of the first or second bodies;

wherein when the first and second bodies are assembled together with the respective inner faces facing one another and the respective longitudinal axes being parallel to one another, the inner faces together define a cylindrical chamber with a cylinder axis that extends parallel to the longitudinal axes, wherein the cylindrical chamber has a first radius and extends substantially entirely around the cylinder axis in a circumferential direction, for receiving a container for the fluid with a cylindrical portion having the first radius;

wherein each of the first and second bodies is solid and comprises a material or alloy with a thermal conductivity of at least 75 $Wm^{-1}K^{-1}$ when at zero degrees Fahrenheit that extends substantially uniformly throughout substantially the entire body.

2. The cooling device of claim 1, wherein the first radius is 33 mm.

3. The cooling device of claim 1, wherein at least one of the first or second bodies comprises a projection configured to engage a recess on the other one of the first or second bodies to restrict relative movement between the first and second bodies in at least one direction transverse to the longitudinal axes.

4. The cooling device of claim 1, wherein the inner face of each of the first and second bodies is configured to define half of the cylindrical chamber.

5. The cooling device of claim 1, wherein the cylindrical chamber is open at at least one of the first ends of the first and second bodies or the second ends of the first and second bodies.

6. The cooling device of claim 1, wherein the cylindrical chamber has a constant cross-section over substantially an entire length of the cooling device.

7. The cooling device of claim 1, wherein the handle comprises a knob connectable to an outside of the at least one of the bodies.

8. The cooling device of claim 1, wherein for at least one of the first body or the second body, a minimum distance between a recess defining the cylindrical chamber and one of the side faces is at least a minimum distance between the recess and the outer faces.

9. The cooling device of claim 1, wherein the first and second bodies are permanently connected to one another.

10. The cooling device of claim 9, wherein the connection is a hinged connection.

11. The cooling device of claim 1, wherein the cylindrical chamber is formed between the inner faces of the first and second bodies.

12. A cooling device for cooling a fluid, the cooling device comprising:

a first body having a first end, a second end, and a longitudinal axis extending between the first and second ends, the first body comprising an inner face, an outer face, and two side faces connecting the inner and outer faces, wherein the inner face, the outer face, and the side faces extend from the first end to the second end;

a second body having a first end, a second end, and a longitudinal axis extending between the first and second ends, the second body comprising an inner face, an outer face, and two side faces connecting the inner and outer faces, wherein the inner face, the outer face, and the side faces extend from the first end to the second end; and a handle that extends away from a surface of at least one of the first or second bodies;

wherein when the first and second bodies are assembled together with the respective inner faces facing one another and the respective longitudinal axes being parallel to one another, the inner faces together define an internal chamber having a first cross-section for receiving a container for the fluid with the first cross-section and a central axis that extends parallel to the longitudinal axes, while at least one of the first or second bodies comprises a projection configured to engage a recess on the other one of the first or second bodies to restrict relative movement between the first and second bodies in at least one direction transverse to the longitudinal axes;

wherein each of the first and second bodies is solid and comprises a material or alloy with a thermal conductivity of at least 75 $Wm^{-1}K^{-1}$ when at zero degrees Fahrenheit that extends substantially uniformly throughout substantially the entire body.

13. The cooling device of claim 12, wherein the first cross-section is circular such that at least part of the chamber is cylindrical with a radius of 33 mm.

14. The cooling device of claim 12, wherein when the first and second bodies are assembled to one another, the first and second bodies are movable away from one another in another direction transverse to the longitudinal axes.

15. The cooling device of claim 12, wherein when the first and second bodies are assembled to one another, the first and second bodies are movable relative to one another in opposing directions parallel to the longitudinal axes.

16. The cooling device of claim 12, wherein the second body forms a base of the cooling device, and wherein the first body is configured to be positioned on top of the second body when the first and second bodies are assembled together.

17. The cooling device of claim 16, wherein the first body comprises the projection and the second body defines the recess configured to engage the projection of the first body, such that the first body is heavier than the second body.

18. A cooling device for cooling a fluid, the cooling device comprising:

a body having a first end, a second end, and a longitudinal axis extending between the first and second ends, the body comprising a first face, an opposite second face, and two side faces connecting the first and second faces, wherein the first face, the second face, and the side faces extend from the first end to the second end; and a handle that extends away from a surface of the body;

wherein at least part of the first face defines a cylindrical segment-shaped recess with a cylinder axis that extends parallel to the longitudinal axis, wherein the cylindrical segment-shaped recess has a first radius of curvature and extends at least halfway around the cylinder axis in a circumferential direction, for receiving a container for the fluid with a cylindrical portion having the first radius;

wherein the second face is at least partially planar; and wherein the body is solid and comprises a material or alloy with a thermal conductivity of at least 75 $Wm^{-1}K^{-1}$ when at zero degrees Fahrenheit that extends substantially uniformly throughout substantially the entire body.

19. The cooling device of claim 18, wherein the first radius is 33 mm.

20. The cooling device of claim 18, wherein an electronic display is formed on an outside of the body for displaying a property associated with cooling the fluid.

* * * * *